US008898963B1

(12) United States Patent
Amatruda et al.

(10) Patent No.: US 8,898,963 B1
(45) Date of Patent: Dec. 2, 2014

(54) ROOFING SHINGLES WITH REDUCED USAGE OF CONVENTIONAL SHINGLE MATERIAL AND HAVING A COMBINATION VERTICAL AND LATERAL LAP EXTENSION

(71) Applicants: Anna M. Amatruda, East Norriton, PA (US); Peter Chihlas, Lansdale, PA (US); Gregory F. Jacobs, Oreland, PA (US); Robert L. Jenkins, Honey Brook, PA (US); Stephen A. Koch, Collegeville, PA (US); Jennifer A. Millberg, Boston, MA (US); Richard A. Snyder, Eagleville, PA (US); Dale H. Walton, Royersford, PA (US)

(72) Inventors: Anna M. Amatruda, East Norriton, PA (US); Peter Chihlas, Lansdale, PA (US); Gregory F. Jacobs, Oreland, PA (US); Robert L. Jenkins, Honey Brook, PA (US); Stephen A. Koch, Collegeville, PA (US); Jennifer A. Millberg, Boston, MA (US); Richard A. Snyder, Eagleville, PA (US); Dale H. Walton, Royersford, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 13/667,443

(22) Filed: Nov. 2, 2012

Related U.S. Application Data

(60) Provisional application No. 61/555,365, filed on Nov. 3, 2011.

(51) Int. Cl.
*E04D 1/28* (2006.01)

(52) U.S. Cl.
CPC ..... *E04D 1/28* (2013.01)
USPC ..... 52/97; 52/409; 52/518; 52/551

(58) Field of Classification Search
CPC ..... E04D 1/22; E04D 1/26; E04D 1/28; E04D 5/10; E04D 5/12; E04D 12/002; E04D 2001/005
USPC ..... 52/556, 746.11, 543, 416, 419–420, 52/551–552, 97, 518–519, 535, 549, 408, 52/409; 156/71; 427/207.1, 208.4; 428/141, 143
See application file for complete search history.

(56) References Cited

U.S. PATENT DOCUMENTS 1,340,348 A * 5/1920 Rahr ..... 52/105
2,013,556 A * 9/1935 Eckert ..... 52/541

(Continued)

FOREIGN PATENT DOCUMENTS

CA 363127 A 5/1937

OTHER PUBLICATIONS

U.S. Appl. No. 13/667,349, filed Nov. 2, 2012, Inventors: Anna M. Amatruda et al.

(Continued)

*Primary Examiner* — Jeanette E Chapman
(74) *Attorney, Agent, or Firm* — Alexander H. Plache; Abel Law Group, LLP

(57) ABSTRACT

A roofing shingle includes a shingle body having a buttlap portion with a butt edge and a headlap portion with a head edge, a first side edge and a second side edge. An exposure zone extends from the butt edge toward the headlap portion and is configured to be exposed to the environment when the shingle is installed on a roof. A water impermeable sheet is attached to the shingle body and has a width, length, first end and second end. The width extends from between about the butt and head edges to beyond the head edge of the shingle body. The length extends from between about the first and second side edges to beyond the first side edge. The sheet is formed from a different material than the shingle body.

13 Claims, 20 Drawing Sheets

(56) References Cited

U.S. PATENT DOCUMENTS

| | | | | | |
|---|---|---|---|---|---|
| 3,415,029 | A | * | 12/1968 | Coletta | 52/419 |
| 4,010,590 | A | * | 3/1977 | Reinke | 52/533 |
| 4,023,321 | A | | 5/1977 | Smith | |
| 4,050,209 | A | * | 9/1977 | Barker et al. | 52/478 |
| 4,102,107 | A | * | 7/1978 | Barker et al. | 52/553 |
| 4,194,335 | A | | 3/1980 | Diamond | |
| 4,352,837 | A | | 10/1982 | Kopenhaver | |
| 4,459,788 | A | | 7/1984 | Bockwinkel et al. | |
| 4,706,435 | A | | 11/1987 | Stewart | |
| 4,731,970 | A | * | 3/1988 | Marshall et al. | 52/543 |
| 5,094,058 | A | | 3/1992 | Slocum | |
| 5,181,361 | A | | 1/1993 | Hannah et al. | |
| 5,287,669 | A | | 2/1994 | Hannah et al. | |
| 5,295,339 | A | * | 3/1994 | Manner | 52/518 |
| 5,347,785 | A | | 9/1994 | Terrenzio et al. | |
| 5,375,491 | A | | 12/1994 | Hannah et al. | |
| 5,421,134 | A | | 6/1995 | Hannah et al. | |
| 5,426,902 | A | | 6/1995 | Stahl et al. | |
| 5,428,931 | A | * | 7/1995 | Ragsdale | 52/518 |
| 6,708,456 | B2 | | 3/2004 | Kiik et al. | |
| 6,877,288 | B2 | * | 4/2005 | Shirota | 52/416 |
| 6,936,329 | B2 | | 8/2005 | Kiik et al. | |
| 6,990,779 | B2 | | 1/2006 | Kiik et al. | |
| 7,448,177 | B2 | | 11/2008 | McClintick | |
| 7,454,873 | B2 | | 11/2008 | McClintick | |
| 7,537,820 | B2 | | 5/2009 | Kalkanoglu et al. | |
| 8,557,366 | B2 | * | 10/2013 | Harrington et al. | 428/141 |
| 8,667,758 | B2 | | 3/2014 | Fernandez Fernandez | |
| 2003/0097811 | A1 | | 5/2003 | Becker et al. | |
| 2003/0230040 | A1 | * | 12/2003 | Shirota | 52/302.1 |
| 2004/0182032 | A1 | | 9/2004 | Koschitzky | |
| 2006/0059832 | A1 | | 3/2006 | McClintick | |
| 2006/0201094 | A1 | | 9/2006 | Lassiter | |
| 2007/0039274 | A1 | * | 2/2007 | Harrington et al. | 52/518 |
| 2007/0042158 | A1 | | 2/2007 | Belt et al. | |
| 2007/0094976 | A1 | | 5/2007 | McClintick | |
| 2007/0151171 | A1 | | 7/2007 | McClintick | |
| 2008/0155923 | A1 | | 7/2008 | Teng et al. | |
| 2011/0041446 | A1 | * | 2/2011 | Stephens et al. | 52/556 |
| 2011/0061326 | A1 | | 3/2011 | Jenkins | |

OTHER PUBLICATIONS

U.S. Appl. No. 13/667,418, filed Nov. 2, 2012, Inventors: Anna M. Amatruda et al.

Technical search, 4 pgs, 2012.

Technical search, 7 pgs, 2012.

* cited by examiner

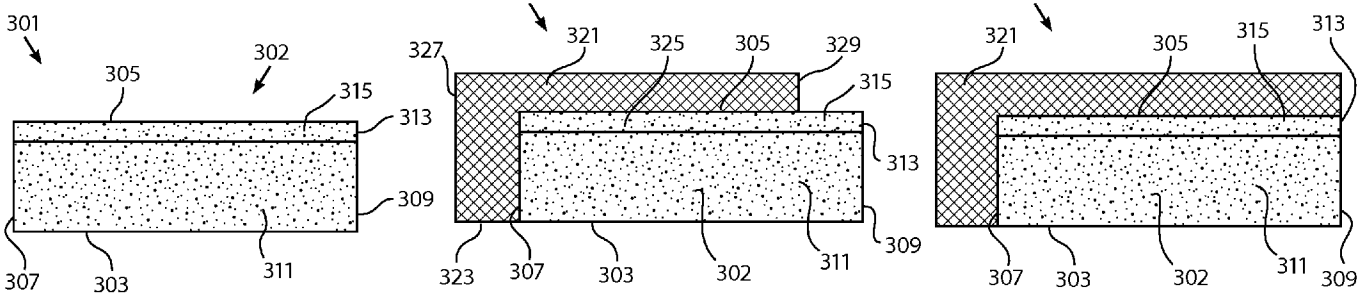
FIG. 3a
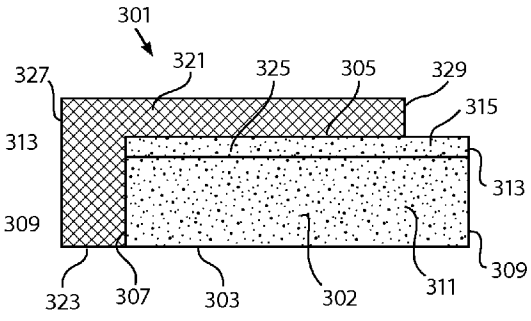
FIG. 3b
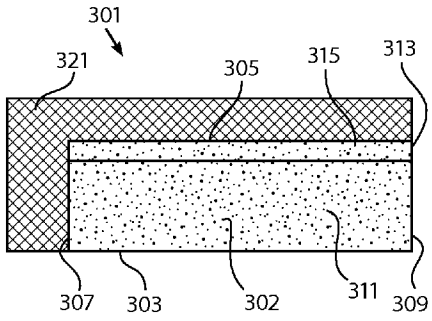
FIG. 3c
FIG. 3d
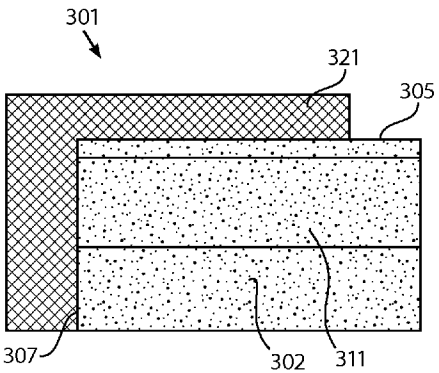
FIG. 3e
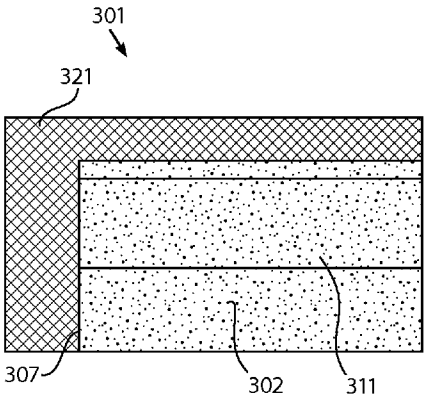
FIG. 3f

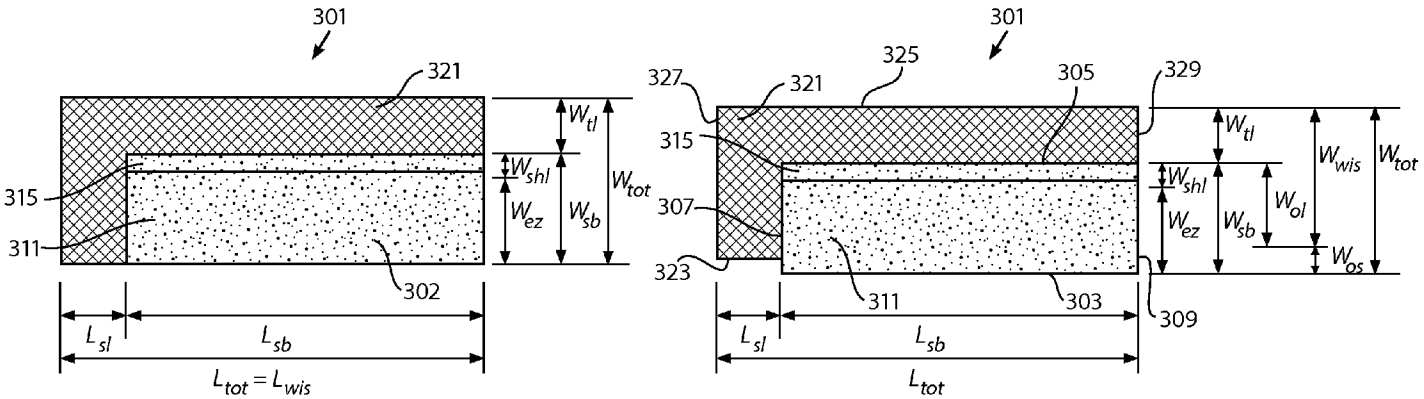
FIG. 4a
FIG. 4b
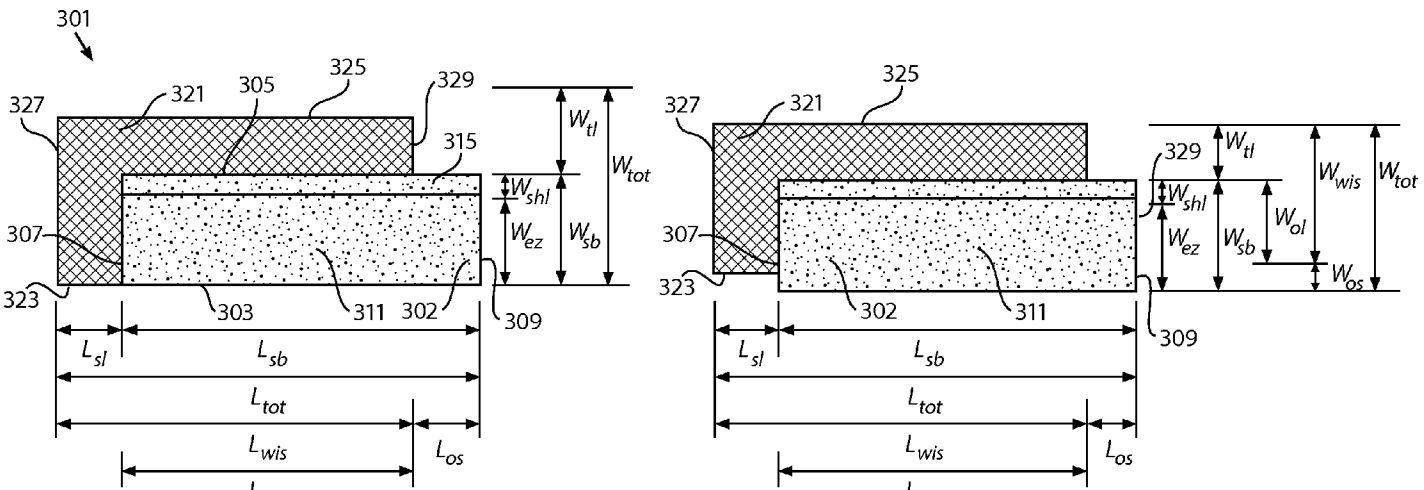
FIG. 4c
FIG. 4d

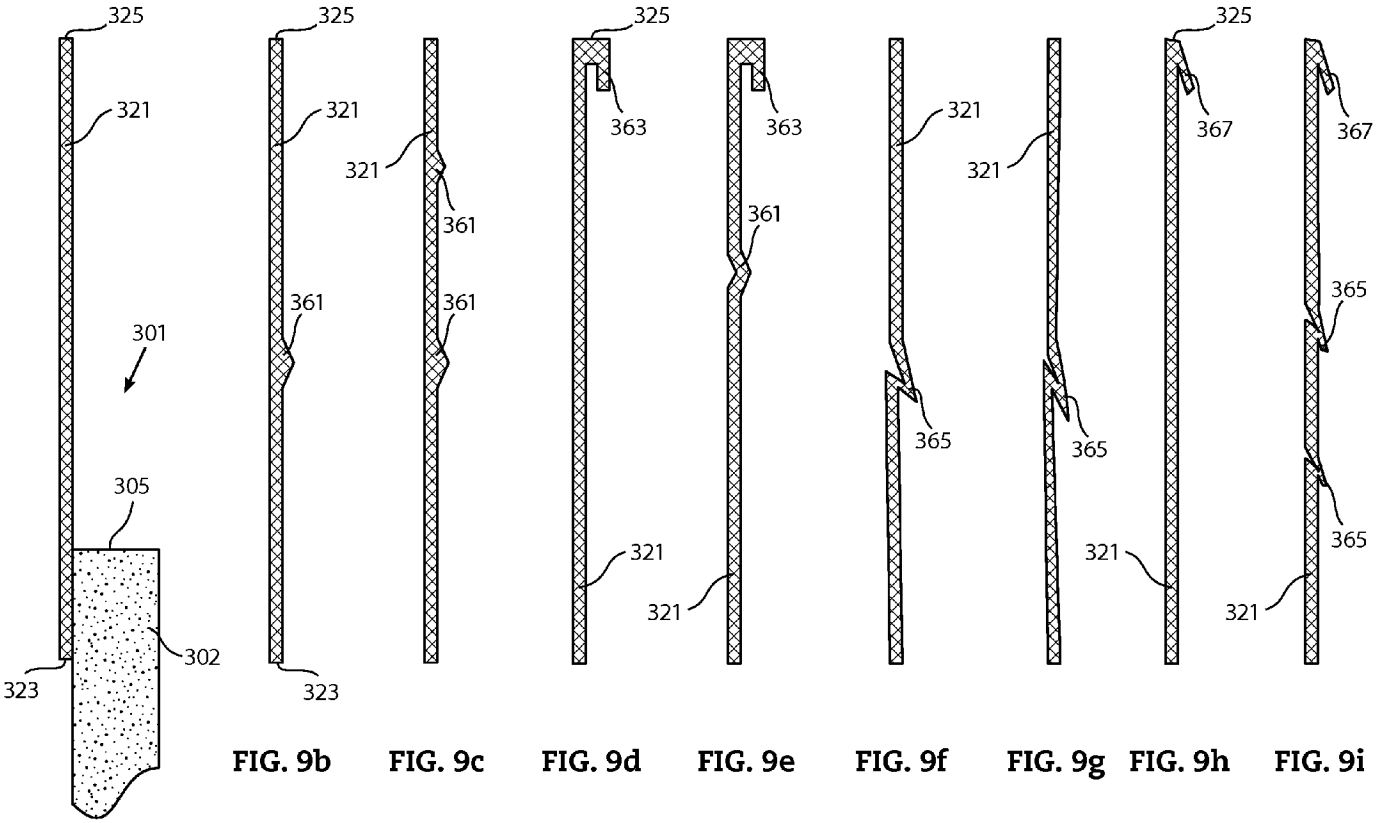
FIG. 9a
FIG. 9b
FIG. 9c
FIG. 9d
FIG. 9e
FIG. 9f
FIG. 9g
FIG. 9h
FIG. 9i
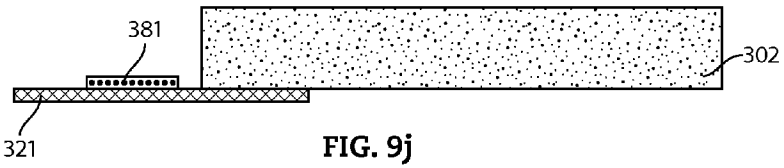
FIG. 9j

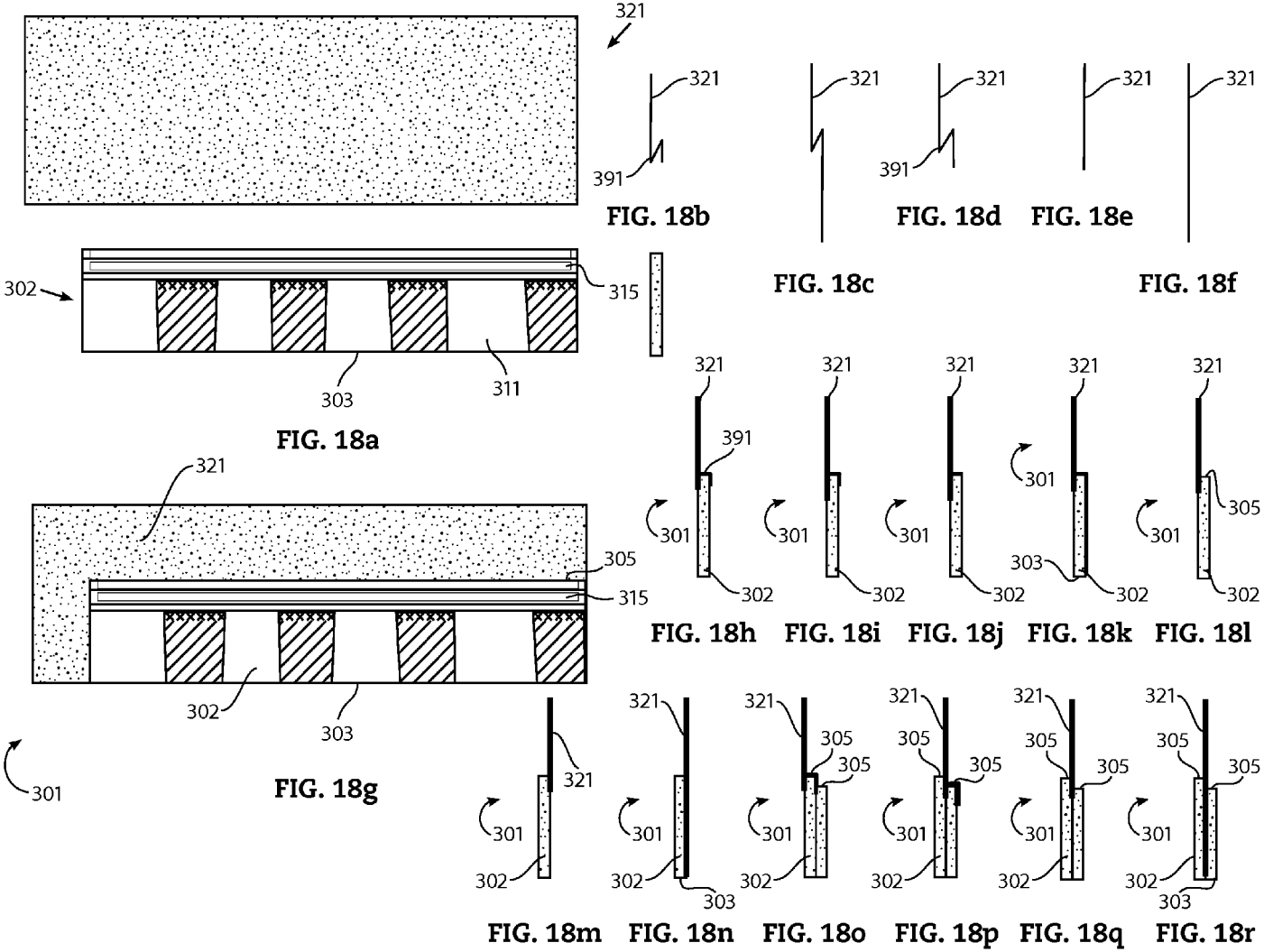
FIG. 18a FIG. 18b FIG. 18c FIG. 18d FIG. 18e FIG. 18f FIG. 18g FIG. 18h FIG. 18i FIG. 18j FIG. 18k FIG. 18l FIG. 18m FIG. 18n FIG. 18o FIG. 18p FIG. 18q FIG. 18r

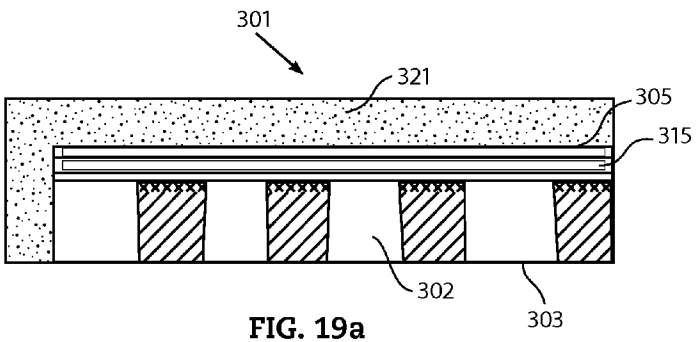
FIG. 19a
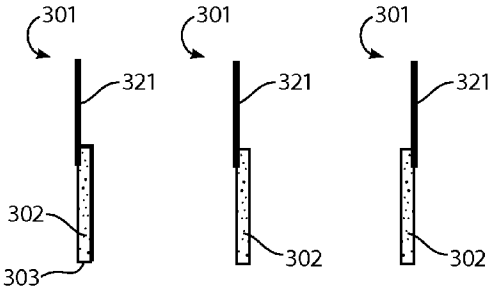
FIG. 19b
FIG. 19c
FIG. 19d
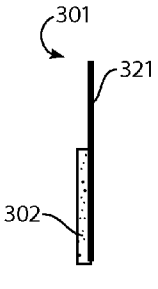
FIG. 19e
FIG. 19f
FIG. 19g
FIG. 19h
FIG. 19i
FIG. 19j
FIG. 19k
FIG. 19l
FIG. 19m
FIG. 19n

ROOFING SHINGLES WITH REDUCED USAGE OF CONVENTIONAL SHINGLE MATERIAL AND HAVING A COMBINATION VERTICAL AND LATERAL LAP EXTENSION

This application claims priority to and the benefit of U.S. Provisional Patent Application No. 61/555,365, filed Nov. 3, 2011, which is incorporated herein by reference in its entirety.

BACKGROUND OF THE INVENTION

Field of the Disclosure

In the art of shingle and siding manufacture, it is known to manufacture shingles of an asphalt impregnated organic or inorganic web, having granules on an outer surface thereof, and having smaller particles on an opposite surface, comprising complete layers of shingle material, examples of which are present in U.S. Pat. Nos. 4,352,837; 5,181,361; 5,287,669; 5,347,785; 5,375,491; 5,421,134; 5,426,902, as well as many other patents. Sometimes, these shingles are comprised of a plurality of complete layers of shingle material, adhered together as a laminate, and sometimes they are comprised of a single complete layer of shingle material, with or without an overlay comprised of an additional layer of adhesive, and an additional layer of granules applied thereto. In addition to structures such as the above identified shingles functioning as shingles, sometimes similar structures are used to function as components of siding, to be applied to side walls of a building structure, rather than the roof of a building structure.

An object of the invention is to provide a roofing shingle product having reduced usage of conventional shingle materials while still closing a roof to protect a structure from the environment. Simply eliminating a headlap portion of a shingle and leaving the fastening zone and exposure zone in place for installation and application of shingles can produce the appearance and aesthetic effect of a shingled roof. However, typical headlaps extend above the exposure zone to a distance higher than the first overlying course of shingles and to a point where they at least in part underlie the lower end of the second overlying course of shingles. Removal of a significant portion of the headlap shingle material can leave potential leak points between pairs of adjacent shingles where no shingle material is beneath a joint between adjacent shingles. This invention provides a solution to the problem of closing a shingle installation using shingles having exposure zones of conventional shingle materials and reduced amounts of conventional material above the exposure zone.

US 20070039274A1 discloses a roofing shingle includes a buttlap portion with a butt edge and a headlap portion with a head edge. The roofing shingle includes a coated mat which is a roofing mat coated with an organic-based coating material. The roofing shingle also includes a water impermeable sheet adjacent to the coated mat. In one embodiment, the headlap portion of the coated mat is mostly replaced by the sheet. In another embodiment, the roofing shingle has a limited width. In a further embodiment, the roofing shingle is reduced in weight compared to a conventional shingle.

U.S. Pat. No. 6,708,456 discloses roofing composite comprising a roofing material and an interply material attached to the roofing material. The interply material is attached adjacent to an edge of the roofing material and is scored to permit a major portion of the interply material to be folded away from the roofing material for application to a roof. The roofing material may be a roofing shingle or roll roofing and the interply material is comprised of a water resistant material.

U.S. Pat. No. 6,936,329 discloses a fastener-free composite roofing product comprising a roofing material and an interply material attached to the roofing material, wherein the interply material includes an adhesive coating on one side. The interply material is attached adjacent to an edge of the roofing material to permit a major portion of the interply material to be folded away from the roofing material for application to a roof. The adhesive is effective to secure the roofing product to the roof without the use of nails or other fasteners. The roofing material may be a roofing shingle or roll roofing, and the interply material is comprised of a water resistant material.

U.S. Pat. No. 6,990,779 discloses a roofing system having a multiplicity of courses of roofing shingles and interply material having at least one course of interply material overlapping at least about ten percent of a first course of shingles and a second course of shingles overlapping at least a portion of the interply material and the first course of shingles. More than about 40% of the first course of shingles is exposed after installation. The roofing system has a class A fire resistant rating. Roofing shingles having particular utility in the roofing system of the present invention are also disclosed. In preferred embodiments the shingles have an exposure width of at least about 60% of the shingle, more preferably at least about 64% of the width of the shingle.

US 20040182032A1 discloses a multi-layer laminate shingle having a base layer and at least a second layer above the base layer. At one end of the shingle the base layer projects beyond the second layer while at the other end the second layer projects beyond the base layer. When the shingles are laid in a course along the roof, the projecting end of the second layer overlaps the projecting end of the base layer of the next shingle, forming a shiplap joint over all or substantially all of the width of the shingle, protecting the joint against rain penetration. This shiplap feature allows the headlap to exposure ratio of the shingle to be reduced to less than 1 and even to 0.5 or less, thus reducing the cost of shingles per unit of roof coverage area. If desired, a narrow strip can be adhered to the top of the headlap portion of the shingle or beneath the butt portion of the shingle to emulate the appearance of a costly triple laminate shingle.

U.S. Pat. No. 4,459,788 discloses a wood shingle panel including an elongated backing sheet and a face layer adhesively bonded together, the face layer being composed of a double course of half-length shingle sections formed by severing standard full-length tapered wood shingles midway between their tip and butt ends. The butt end portions of the tip shingle sections are located adjacent to the lower longitudinal edge of the backing sheet and the tip end portions of the butt shingle sections are located adjacent to the upper longitudinal edge of the backing sheet. The butt end portions of the butt shingle sections are arranged along the central portion of the backing sheet and overlie the tip end portions of the tip shingle sections. The butt end portions of the butt shingle sections are rabbeted for receiving the tip end portions of the tip shingle sections in the rabbet. The lower margin of the backing sheet may be rabbeted beneath the butt portions of the tip shingle sections to overlap the upper margin of the next lower panel.

U.S. Pat. No. 5,094,058 discloses a roofing shingle having a body portion of generally flat, four-sided polygonal configuration and relatively thin in thickness. The body portion is provided with a plurality of irregular corrugations or otherwise deformed to give the roofing shingle the appearance of natural wood or other natural material such as slate. The body portion has a channel formed in the under surface so that the upper surface forms a ridge extending substantially parallel to the upper edge of the body portion. The body portion is also provided adjacent each of the opposite side or vertical edges with raised portions which are so shaped and dimensioned as to have one raised portion nest within the raised portion of a next adjacent like roofing shingle. The ridge and nested raised portions form barriers to water infiltration between the overlapping shingles.

In U.S. Pat. No. 4,731,970 a shingled panel for covering the exterior of structures is disclosed which includes a base sheet having at least one, and preferably multiple courses of shingles secured thereto. The lowest course of shingles are positioned over a water resistant membrane strip having an opening through which the shingles are glued directly to the base sheet. Each higher course of shingles has a membrane strip thereunder which terminates short of the bottom of each shingle in that course so that glue bond between the lower portion of each shingle in that course and the shingles in the next lower course can be achieved. Side-to-side sealing of adjacent panels is effected by the end shingles in alternate courses of shingles extending beyond the edges of the panel, while the end shingles in the same courses at the opposite ends similarly are laterally recessed from the edges of the panel. Moreover, laterally recessed end shingles have a thickness dimension greater than laterally protruding end shingles to facilitate nesting of shingles from laterally adjacent panels in overlapped, side-by-side relation across the joint between adjacent panels.

US 20060059832A1, US 20070094976A1, US 20070151171A1, U.S. Pat. No. 7,448,177 and U.S. Pat. No. 7,454,873 disclose a slate roofing system with reduced dimension slates having an interlayment approach to closing gaps between tiles.

BRIEF DESCRIPTION OF THE DRAWINGS

FIGS. 3*a*-3*f* are plan views of embodiments of shingles.

FIGS. 4*a*-4*d*, 5*a*-5*b*, 6*a*-6*d*, 7*a*-7*f*, 8*a*-8*f*, 9*a*-9*j*, 10*a*-10*i*, 11*a*-11*h*, 12*a*-12*f* and 13*a*-13*d* are plan and side views of alternate embodiments of shingles.

FIGS. 18*a*-18*r* and 19*a*-19*n* are plan and side views of alternate embodiments of shingles.

DETAILED DESCRIPTION

Figure 1A:
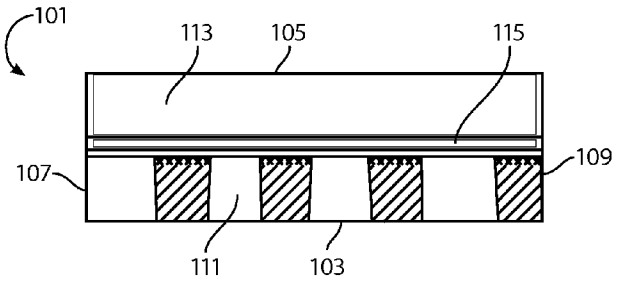
FIGS. 1*a*-1*d* and 2*a*-2*b* are plan views of conventional shingles.

In a first aspect, a roofing shingle comprises: a shingle body comprising a buttlap portion with a butt edge and a headlap portion with a head edge, a first side edge and a second side edge, and; a water impermeable sheet adjacent to the shingle body, the sheet having a length and a width the length extending from beyond the first side edge to the second edge of the shingle body, and the width extending from below the head edge to beyond the head edge of the shingle body, the water impermeable sheet also having an upper edge and a lower edge. The shingle body has an exposure zone extending upwardly from the butt edge toward the headlap portion that is exposed to the environment when the shingle is installed on a roof and provides weather protection and aesthetic effect to the roof. The shingle body also has a fastening zone that is between the exposure zone and the head edge of the shingle body. The width of the headlap portion of the shingle body is less than the width of the exposure zone. The width of the water impermeable sheet extends beyond the head edge of the shingle body. The water impermeable sheet extension above the shingle body and beyond the side edge of the shingle body provides a top and side lapping structure of a different material from that of the shingle body that closes a shingled roof to water penetration.

In another aspect, a roofing shingle comprises a shingle body comprising a buttlap portion with a butt edge and a headlap portion with a head edge, a first side edge and a second side edge, and; a water impermeable sheet adjacent to the shingle body, the sheet having a width and a length, the width extending from between the butt edge and the head edge to beyond the head edge of the shingle body; and the length extending between the first and second side edges to beyond the first side edge of the shingle body. In some embodiments, the water impermeable sheet has a first end that extends beyond the first side edge such that a first distance between the first end and the first side edge is at least about 10% of a second distance between the end of the water impermeable sheet and the second edge, and an upper edge that extends beyond the head edge of the shingle body by a third distance, the third distance being greater than or equal to the first distance. In some cases, the length of the water impermeable sheet extends approximately to the second side edge of the shingle body. In other cases, the water impermeable sheet has a second end that extends toward the second side edge of the shingle body such that second end of the sheet is closer to the first edge from the second edge by a fourth distance that is approximately the same as the first distance.

In a second aspect, the shingle is as described in first aspect above, wherein, the width of the water impermeable sheet extends approximately to the butt edge of the shingle body, the lower edge of the water impermeable sheet being proximate the butt edge of the shingle body.

In a third aspect, the lower edge of the water impermeable sheet is offset upwardly from the butt edge of the shingle body by an amount less than the width of the exposure zone of the shingle body.

In a fourth aspect, the shingle is as described in first aspect above, wherein, the length of the water impermeable sheet extends approximately to the second side edge of the shingle body, the second side edge of the water impermeable sheet being proximate the second side edge of the shingle body.

In a fifth aspect, the second side edge of the water impermeable sheet is offset inwardly from the second side edge of the shingle body by an amount less than the length of the extension of the first side edge of the water impermeable sheet beyond the first side edge of the shingle body.

In another aspect the shingle body emulates two or more courses of conventional shingles.

In certain embodiments the top and side lapping structure includes structural elements that have raised portions that result in moisture diverting pathways to direct any moisture that may enter into the joint between two adjacent shingles or beneath the butt edge of the shingle on a sloped roof in a downward direction so that the roof may drain and not have water enter the building.

In other embodiments, sealants are provided that further close the roof to moisture entrance. In some cases continuous sealants provide a barrier to moisture intrusion. In other cases patterns or structures formed by the sealants provide barriers and drainage pathways to prevent moisture intrusion.

The accompanying drawings will help explain the invention. The drawings are not necessarily to scale, and sizes of various elements can be distorted for clarity.

Figure 1B:
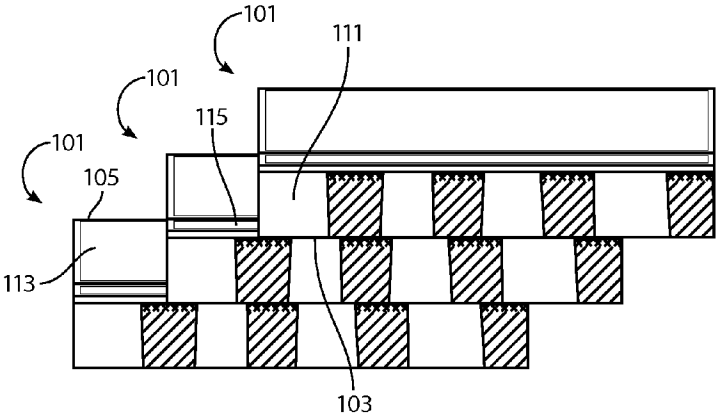

FIG. 1*a* shows a top view of a typical laminated shingle 101. The shingle 101 has a butt edge 103, a head edge 105 and first and second side edges 107, 109, respectively. The exposure zone 111 is adjacent the butt edge 103. The headlap zone 113 is adjacent the head edge 105. The fastening zone 115 is between the exposure zone 111 and the headlap zone 113. FIG. 1*b* shows three such shingles 101 arranged in a laterally offset, partially overlapping array, much as would be the case if the shingles 101 were laid up on a roof. The fastening zone 115 of an underlying shingle is covered by the exposure zone 111 near the butt edge 103 of the shingles of the next overlying course. The headlap zone 113 extends upwardly to the head edge 105 such that an upper portion of the headlap zone 113 near the head edge 105 of a shingle of a first course of shingles is underlying the fastening zone 115 of a shingle of a second course of shingles, and also underlying the lower end of the exposure zone 111 of a shingle of a third course of shingles in the arrangement.

Figure 1C:
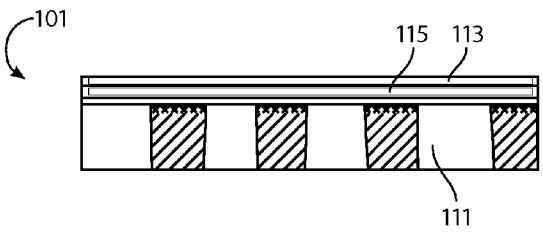
Figure 1D:
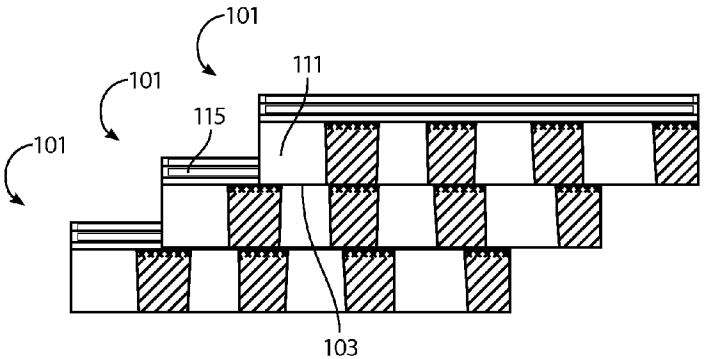

FIG. 1*c* shows a plan view of a similar laminated shingle 101, but with much of the headlap zone 113 omitted. The fastening zone 115 is above the exposure zone 111. FIG. 1*d* shows three such shingles 101 arranged in a laterally offset, partially overlapping array much as would be the case if the shingles 101 were laid up on a roof. The fastening zone 115 of an underlying shingle is covered by the exposure zone 111 near the butt edge 103 of the shingles 101 of the next overlying course.

Figure 2A:
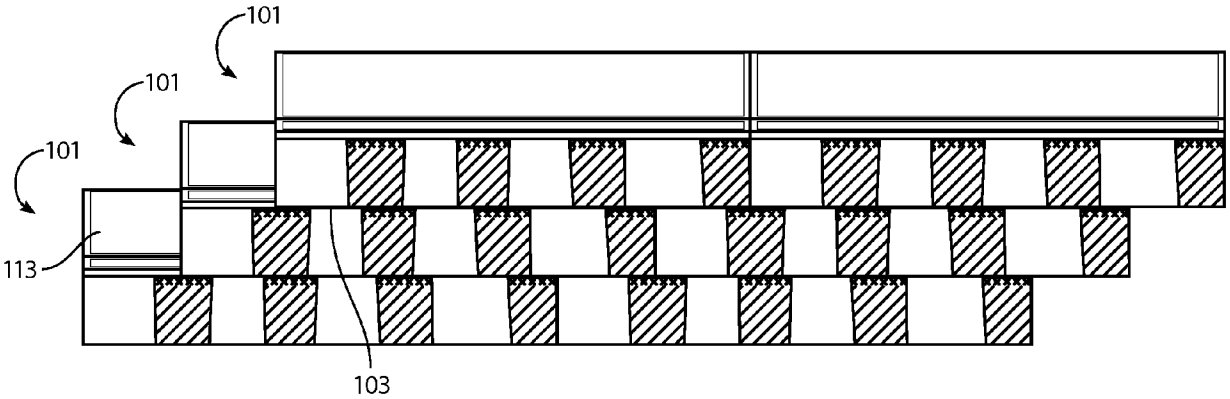
Figure 2B:
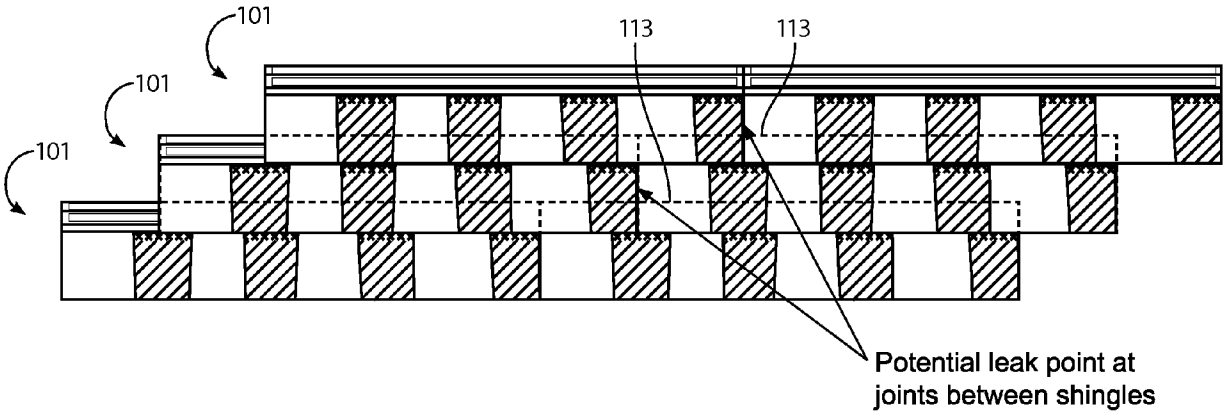

FIG. 2*a* shows two laterally adjacent shingles 101 of FIG. 1*a* arranged in three offset courses as in FIG. 1*b*. FIG. 2*b* similarly shows three courses of pairs of laterally adjacent shingles 101 arrayed as in FIG. 1*d*. In FIG. 2*a*, the headlap zone 113 of the first course extends upwardly beneath the butt edge 103 of the third course. With this arrangement, the joints between adjacent shingles 101 of the second course have the headlap zone 113 of a shingle 101 of the first course underlying the joint so that any water entering the joint will be directed down the roof. Dashed lines in FIG. 2*b* indicate the outline of the underlying shingles 101 in the array. In FIG. 2*b*, it is apparent that the headlap portions 113 of an underlying course of shingles 101 do not extend sufficiently upward to provide closure of the shingled roof in the areas of joints between laterally adjacent shingles 101. Such joints would be a potential leak point in the shingled roof where moisture could enter the joint and not be directed away as is would be the case with conventional shingles 101 as shown in FIG. 2*a*.

FIG. 3*a* shows a top view of a shingle 301 having a shingle body 302 with a buttlap portion 311 with a butt edge 303 and a short headlap portion 313 with a head edge 305, a first side edge 307 and a second side edge 309. It is similar to the shingle depicted in FIG. 1*c*, but without aesthetic embellishment so as to suggest that the appearance of the exposure zone could take on any desired appearance. The shingle body 302 can be a single layer of shingle material, or alternatively, can be a laminated shingle body made up of two or more layers of shingle material.

FIG. 3*b* shows another shingle 301 that further includes a water impermeable sheet 321 adjacent and attached to the shingle body 302, the sheet 302 having a length and a width, and left and right side edges 327, 329, respectively. The length extends from beyond the first side edge 307 through to a point within the shingle body length and not completely to the second side edge 309 of the shingle body 302; and the width extending beyond the head edge 305 of the shingle body 302. The shingle body 302 has an exposure zone 311 extending upwardly from the butt edge 303 toward the headlap portion 313 that is exposed to the environment when the shingle 301 is installed on a roof and provides weather protection and aesthetic effect to the roof. The shingle body 302 also has a fastening zone 315 that is between the exposure zone 311 and the head edge 305. The width of the water impermeable sheet 321 extends beyond the fastening zone 315. The water impermeable sheet 321 extension from the shingle body 302 provides a top and side lapping structure that closes a shingled roof to water penetration as shown later. In some cases, the water impermeable sheet 321 has an upper edge 325 that extends beyond the head edge 305 by an amount greater than or equal to a distance from the butt edge 303 of the shingle body 302 to the fastening zone 315.

FIG. 3*c* shows another shingle 301 that further includes a water impermeable sheet 321 adjacent to the shingle body 302, the sheet 321 having a length and a width, the length extending from beyond the first side edge 307 through the second side edge 309 of the shingle body 302; and the width extending beyond the head edge 305 of the shingle body 302.

The shingles 301 of FIGS. 3*d*, 3*e* and 3*f* are similar to those of 3*a, b* and *c*, except that the exposure zone 311 takes on the area of two courses of conventional shingles. The shingle 301 of FIG. 3*f* has an exposure zone 311 for the effect of two courses of shingles and has a water impermeable sheet 321 adjacent to the shingle body 302 with a width extending beyond the head edge 305 of the shingle body 302 and beyond the first side edge 307 of the shingle body 302. The water impermeable sheet 321 extension from the shingle body 302 provides both top and side lapping structures that close a shingled roof to water penetration and a single shingle provides the effective coverage of two conventional shingles.

FIG. 4 depicts various alternative embodiments of the shingle of FIG. 3*c* and relative dimensions of various components of such embodiments. The shingle has a water impermeable sheet that forms a top and side lap and the water impermeable sheet is attached to the shingle body, in this case, on the rear face of the shingle body. In an alternative arrangement where the shingle body is a laminated shingle body, the water impermeable sheet can optionally be sandwiched between two layers of the laminated construction at a level farther down in the construction than the front face of the shingle body. In yet another alternative embodiment, a portion of the water impermeable sheet may overlap at least a portion of the front face of the shingle body. FIG. 4*a* shows an assembled shingle, FIGS. 4*b, c* and *d* depict alternative shingle embodiments where the shingle body components and water impermeable sheet components have differing relative dimensions.

In FIG. 4, the overall shingle 301 with the water impermeable sheet 321 has a total length Ltot that extends between side edges 327, 329. The shingle body 302 has a length Lsb. The water impermeable sheet 321 forms a top and side lap and has a length of Lwis. In this case, Ltot=Lwis. The shingle body 302 also has a width Wsb, the width including the width of the exposure zone 311 Wez and with width of the fastening zone 315 Wfz. The width of the water impermeable sheet 321 extends above the head edge 305 to form a top lap structure having a width Wtl. The total width of the shingle 301 Wtot being the sum of Wsb and Wtl.

The shingle 301 of FIG. 4*b* has a water impermeable sheet 321 with a width that is less than the total width of the shingle 301. The lower edge 323 of the water impermeable sheet 321 is offset from the butt edge 303 of the shingle body 302 by an offset Wos and has an overlap with the shingle body 302 of Wol. In one embodiment where the water impermeable sheet 321 and the shingle body 302 have about the same width, the offset Wos is about the same as the width of the top lap Wtl. In another embodiment, the offset Wos is equal to or greater than the width of the exposure zone 311 Wez while retaining sufficient overlap Wol to attach the water impermeable sheet 321 to the shingle body 302. When the water impermeable sheet 321 is attached to the shingle body 302, the sheet 321 provides a closure point for the roof and directing any water entering a joint between adjacent shingle bodies 302 downwardly along the roof. The length of the side lap feature extends beyond first side edge 307 of the shingle body 302. In the FIG. 4*b*, the length of the water impermeable sheet 321 is the same as the total length of the shingle 301.

The shingle 301 of FIG. 4*c* has a water impermeable sheet 321 with a width that is greater than that of the shingle body 302 such that Wwis>Wsb. The water impermeable sheet 321 extends downwardly by an overlap Wol of greater than the width of the fastening zone 315 Wfz, and equal to the width of the shingle body 302 Wsb. The length of the side lap feature extends beyond first side edge 307 of the shingle body 302. In the FIG. 4*c*, the length of the water impermeable sheet 321 is approximately the same as the length of the shingle body 302 with a lateral offset inwardly from the second shingle body edge 309 that is approximately the same as the lateral extension beyond the first edge 307 of the shingle body 302. The water impermeable sheet 321 provides a top and side lap that, in the installed state, is beneath the joint between laterally adjacent shingle bodies 302, thus providing a closure point for the roof and directing any water entering a joint between adjacent shingle bodies 302 downwardly along the roof.

The shingle 301 of FIG. 4*d* has a water impermeable sheet 321 with a width that is greater than that of the shingle body 302 such that Wwis>Wsb and the water impermeable sheet 321 extends downwardly toward, but not all the way to, the butt edge 303 of the shingle body 302. In this case, the total width of the shingle 301 including both top lap and shingle body 302 is the sum of the width of the top lap extension and the width of the shingle body 302. The width of overlap Wol is less than the width of the shingle body 302 Wsb. The water impermeable sheet 321 provides a top lap of length Wtl and a length of side lap extension Lsl such that, in the installed state, the water impermeable sheet 321 is beneath the joint between laterally adjacent shingles 301 of a first overlying course, thus providing a closure point for the roof and directing any water entering a joint between adjacent shingle bodies 302 downwardly along the roof.

Figure 5A:
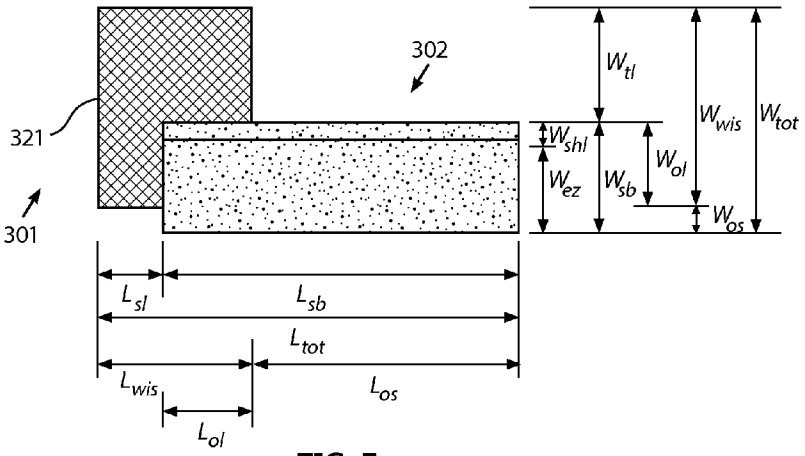
Figure 5B:
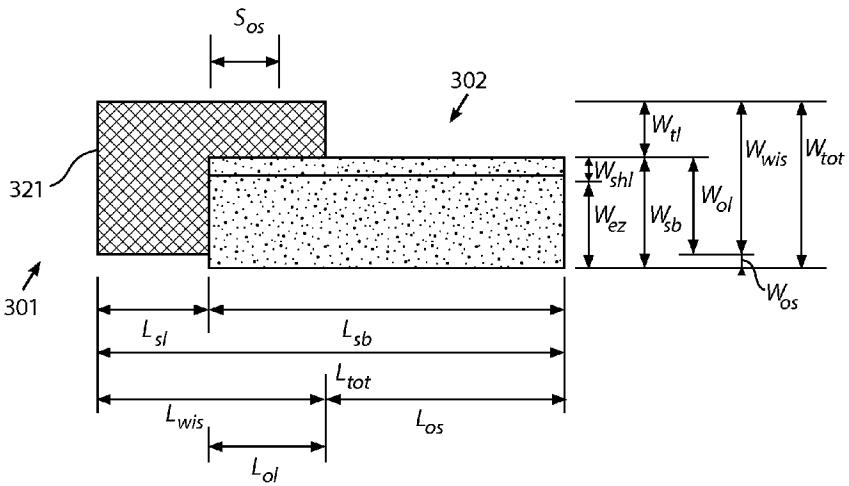

FIGS. 5*a* and 5*b* depict alternative shingles 301 that have a top and side lap extension water impermeable sheet 321 wherein the lengths of the water impermeable sheet 321 are less than one half the length of the shingle body 302. Widths and lengths of the water impermeable sheet 321 relative to the width and length of the shingle body 302 are selected so that closure of the joint between adjacent shingles 301 is obtained when the shingles 301 are laid up on a roof. In a stair step shingle installation, the roof is easily closed. In a racked shingle installation, the length and width of the water impermeable sheet 321 are selected such that with the recommended racking offset, closure of the joint between laterally adjacent shingle bodies 302 is accomplished.

Figure 6B:
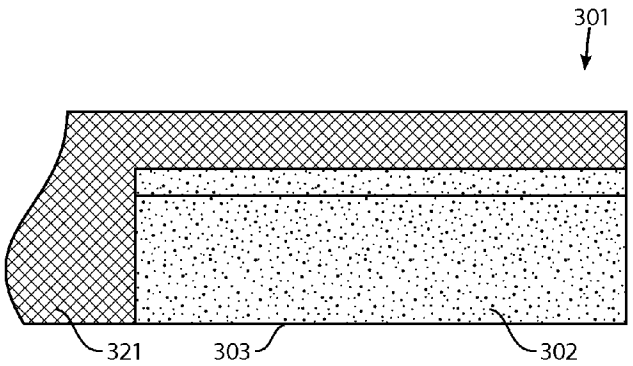
Figure 6D:
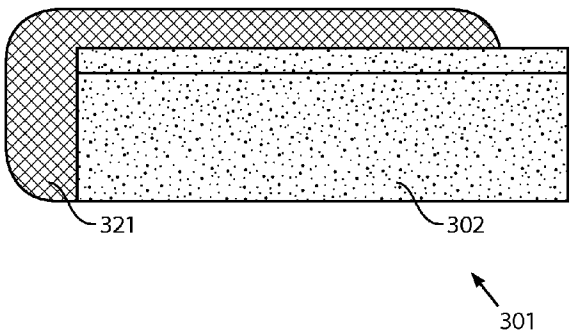
Figure 6A:
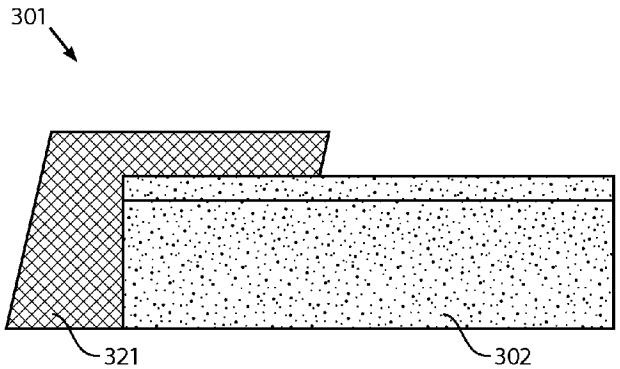
Figure 6C:
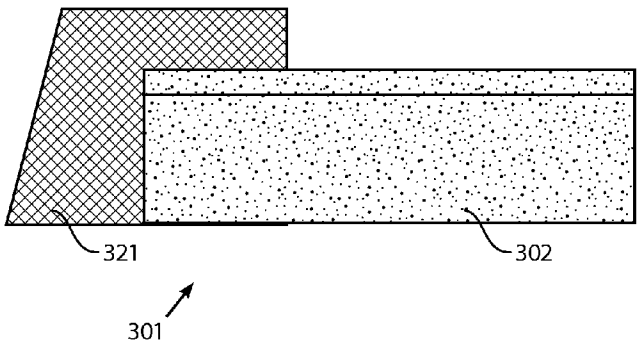

FIGS. 6*a* through 6*c* depict water impermeable sheets 321 attached to shingle bodies 302 where the top and side lap extensions have varying geometries. FIG. 6*a* shows a parallelogram shaped water impermeable sheet 321. In FIG. 6B, the side extension has a curved shape that is greater toward the butt edge 303 of the shingle body 302. The sheet is trapezoidal in FIG. 6*c* and has a rectilinear shape with curved corners in FIG. 6*d*.

Figures 7A, 7B, 7C, 7D, 7E, 7F:
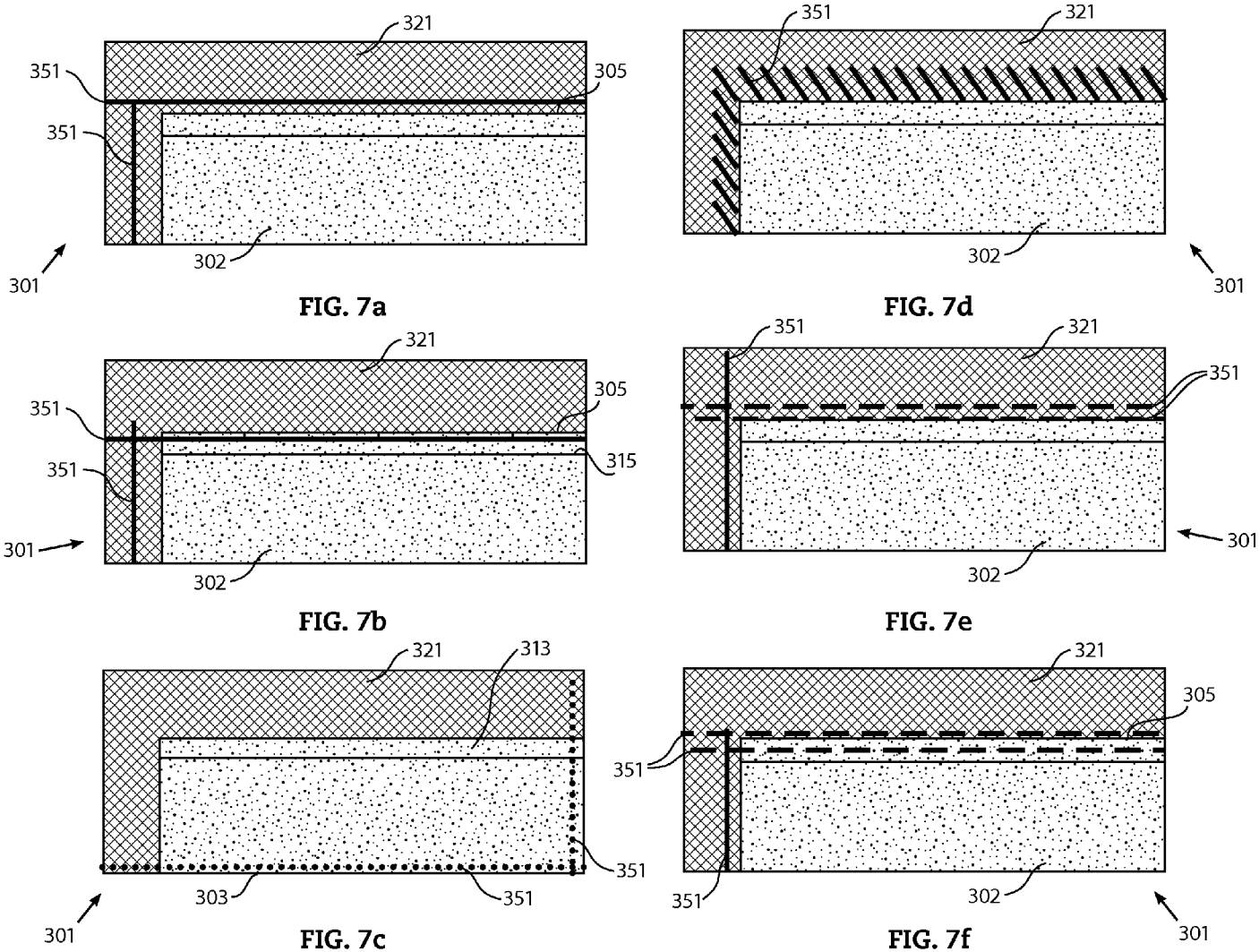

Sealants can also be employed with the top and side lap to enhance closure of the roof. FIG. 7*a* shows a continuous line of sealant 351 on the top surface of the top and side lap 321 near the shingle body 302 that will form a bond with the back surface of an overlying shingle 301 and a laterally adjacent one, further closing the roof and providing a path directing downward travel of any moisture that may enter the joint between adjacent shingles 301. A second or more line of sealant may also be employed (not shown) as a backup sealant. In FIG. 7*b*, a continuous line of sealant 351 is provided on the top of the shingle body 302 adjacent the head edge 305 above the fastening area 315. FIG. 7*c* shows a sealant line 351 (in phantom) on the back surface of the shingle 301 near the butt edge 303 of the shingle 301 opposite that of the top and lap portions 321. Such a sealant 351 forms a bond between the back of the shingle 301 and the top surface of the upper edge portion 313 of an underlying installed shingle 301 and the top surface of the side lap extension 321 of a laterally adjacent shingle 301. One or more of the sealant lines 351 may be continuous or discontinuous. FIG. 7*d* shows an alternative sealant arrangement where lines of sealant 351 are arranged in a chevron-like pattern so that there are no direct upward paths for intruding water. The sealant lines 351 are arranged so that they direct any water downwardly along the roof. FIG. 7*e* shows a pair of sealant lines in a discontinuous configuration with the adjacent lines of sealant being laterally offset so that a direct upward path for water is avoided. FIG. 7*f* shows an alternative disposition of a pair of discontinuous sealant lines 351 having lateral offsets of the discontinuities where one of the sealant lines 351 is on the surface of the top lap material of the water impermeable sheet 321 and the other sealant line 351 is on the top surface near the head edge 305 of the shingle body 302.

It will be understood that other sealants may also be employed in other locations on the shingle such as on top of the shingle body in or near the fastening zone so that a seal is formed between the top surface of the shingle and the bottom surface of an overlying shingle. Sealants can also be employed on the bottom surface of the shingle in the vicinity of the butt edge of the shingle so that a bond can be formed between the bottom surface of the shingle and the top surface of an underlying shingle. Various sealant arrangements can also include sealants on the top of a shingle near the fastening zone and on the bottom of a shingle near the butt edge on the same shingle. Sealants can be arranged so that in an installed state, the sealant lines match and adhere to one another, or alternatively, sealant lines can be arranged to adhere to the other shingle in a complementary location so as to provide an enhanced bond between the shingles. Still other embodiments may include aspects disclosed in U.S. Pat. Pub. 2011/0061326, which is incorporated herein by reference in its entirety.

Figures 8A, 8B, 8C, 8D, 8E, 8F:
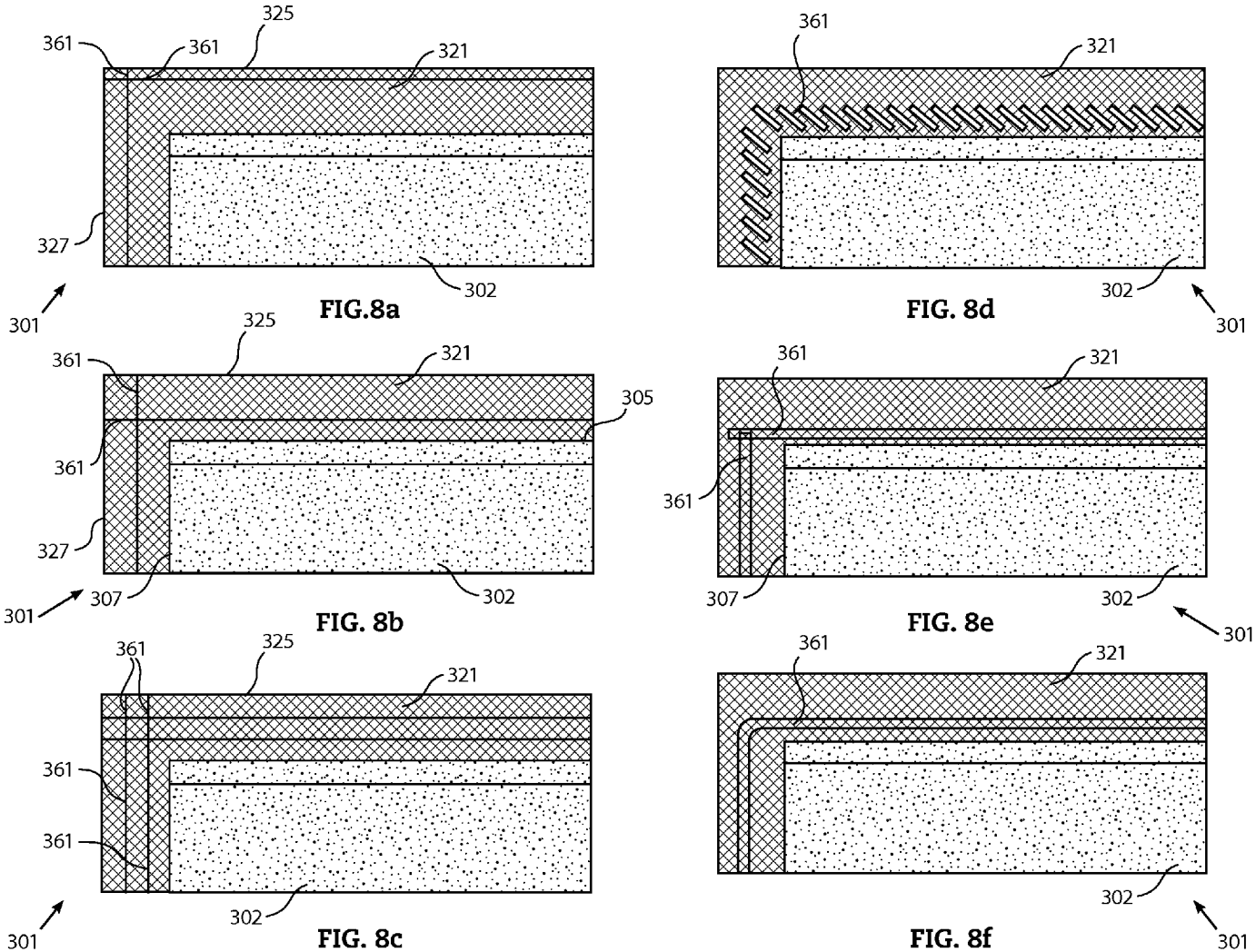

Mechanical structures can also be provided to the top and side lap portion to assist in directing water down a roof in the event that it may enter a joint between adjacent shingles or beneath the butt edge of a shingle. FIG. 8 shows top schematic views of a number of such treatments. FIG. 8*a* shows a top and side lap attached to a shingle body 302 having a raised ridge 361 near the upper edge 325 and near the first side edge 327 of the water impermeable sheet 321. In FIG. 8*b* the top and side lap is provided with a raised feature 361 near the lower edge of the top lap area above the head edge 305 of the shingle body 302 and between the first side edge 327 of the water impermeable sheet 321 and the shingle body 302. The feature is generally parallel to the head edge 305 of the shingle body 302 and spaced at least slightly away from the head edge 305 of the shingle body 302. FIG. 8*c* shows another top and side lap embodiment where a second raised feature 361 is provided as a redundancy in case water were able to find its way over the first feature 361 so there would be a second barrier. FIG. 8*d* shows another embodiment where a plurality of raised features 361 are arranged in a series of chevron-like structures prevention a direct path upwardly under an overlying shingle 301. FIG. 8*e* shows a wider raised feature 361 near the lower edge of the top lap in the vicinity of the head edge 305 of the shingle body 302 and around the side 307 of the shingle body 302. FIG. 8*f* shows a raised feature 361 that curves around the shingle body 302 on the top surface of the water impermeable sheet 321.

In FIG. 9, side edge schematic views of a number of raised structure configurations 361 on the top lap portion of the shingle 301 made up of the water impermeable sheet 321. FIG. 9*a* shows a water impermeable sheet 321 attached to a shingle body 302 near the head edge 305 of the shingle body 302. It will be understood that the attachment to the shingle body 302 may be on the front or rear surface of the shingle body 302, or, in some embodiments, may be an internal attachment between two layers of a laminated shingle body structure. The top lap structure of FIG. 9*a* does not have a raised structure and is substantially planar. It will be further understood that the surfaces of the water impermeable sheet 321 may carry a texture. FIGS. 9*b* through 9*j* show alternative arrangements of water impermeable sheets 321 with the shingle body 302 not shown.

The water impermeable sheet 321 of FIG. 9*b* has a raised feature 361 disposed between the upper and lower edges 325, 323 of the sheet 321 wherein additional material of the same or different constitution is provided to yield a barrier to upwardly directed moisture beneath a shingle body 302. In one aspect, the raised structure 361 is a ridge that traverses the length of the top lap. In another alternative, the raised feature 361 can take on a different shape, such as, for example that the feature 361 of FIG. 8*d*, that of the sealant configuration 351 of FIG. 7*d*, or the like. In FIG. 9*c*, the top lap has two such structures 361. It will also be understood that the raised feature can be present on the side lap portion of the water impermeable sheet 321.

In FIG. 9*d*, the upper edge 325 of the top lap has a folded over inverted J-shaped flange 363 to prevent water from traveling upward beneath and overlying shingle course. The top lap of FIG. 9*e* also has such a J-shaped flange 363, but further has a raised ridge feature 361 that is formed by a crimped structure such that no additional material is needed to create the ridge.

FIG. 9*f* shows an alternative configuration of a raised feature 365 formed by crimping the water impermeable sheet material 321 and directing the raised shape downward so that water intrusion upward would be blocked by the feature, and, if water would somehow find its way above the feature 365, the path back downward would be sloped so as to allow drainage of the roof over the feature. FIG. 9*g* shows a raised feature 365 generated by a pleated structure where the top lap material 321 is crimped and folded back down on itself as a moisture block. In FIG. 9*h*, the upper edge 325 of the sheet material is folded forward and downward to yield a blocking structure 327 similar to the J-shaped structure 363 of FIG. 9*d*. The top lap of FIG. 9*i* has both a folded down upper edge 367 and two pleated raised structures 365 to minimize moisture intrusion.

FIG. 9*j* depicts an alternate embodiment having an additional asphalt portion or component 381 (i.e., separate from the shingle body 302) formed on an upper surface of the water impermeable sheet 321. This component 381 may be spaced apart from the shingle body 302 as shown, and may be used to help properly align and orient the sheet 321 with the shingle body 302 during manufacturing. In addition, this component 381 may be used as an alignment feature for adjacent and/or abutting shingles 301. It will be understood that the top lap of the water impermeable sheet 321 may have any combination of one or more of the above described mechanical structures and sealant arrangements disposed thereupon.

Figures 10A, 10B, 10C, 10D, 10E, 10F, 10G, 10H, 10I:
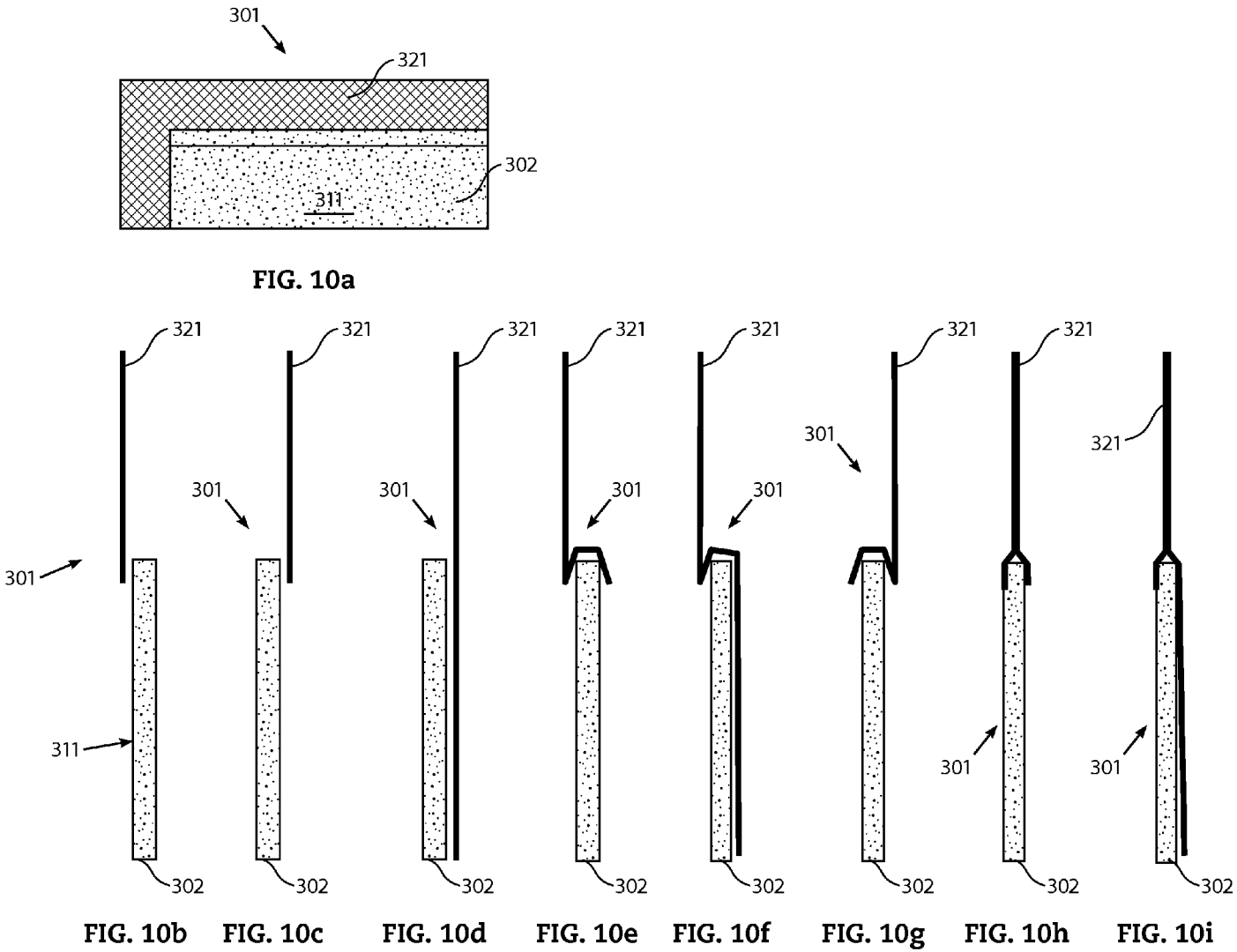

FIG. 10*a* shows a shingle 301 like that of FIG. 4*a*. FIGS. 10*b* through 10*i* show side edge views of a range of attachment approaches for placement of the water impermeable sheet 321 in relation to the shingle body 302. In FIGS. 10*b* through 10*i*, the exposure zone 311 is oriented to the left of the drawings.

Figures 11A, 11B, 11C, 11D, 11E, 11F, 11G, 11H:
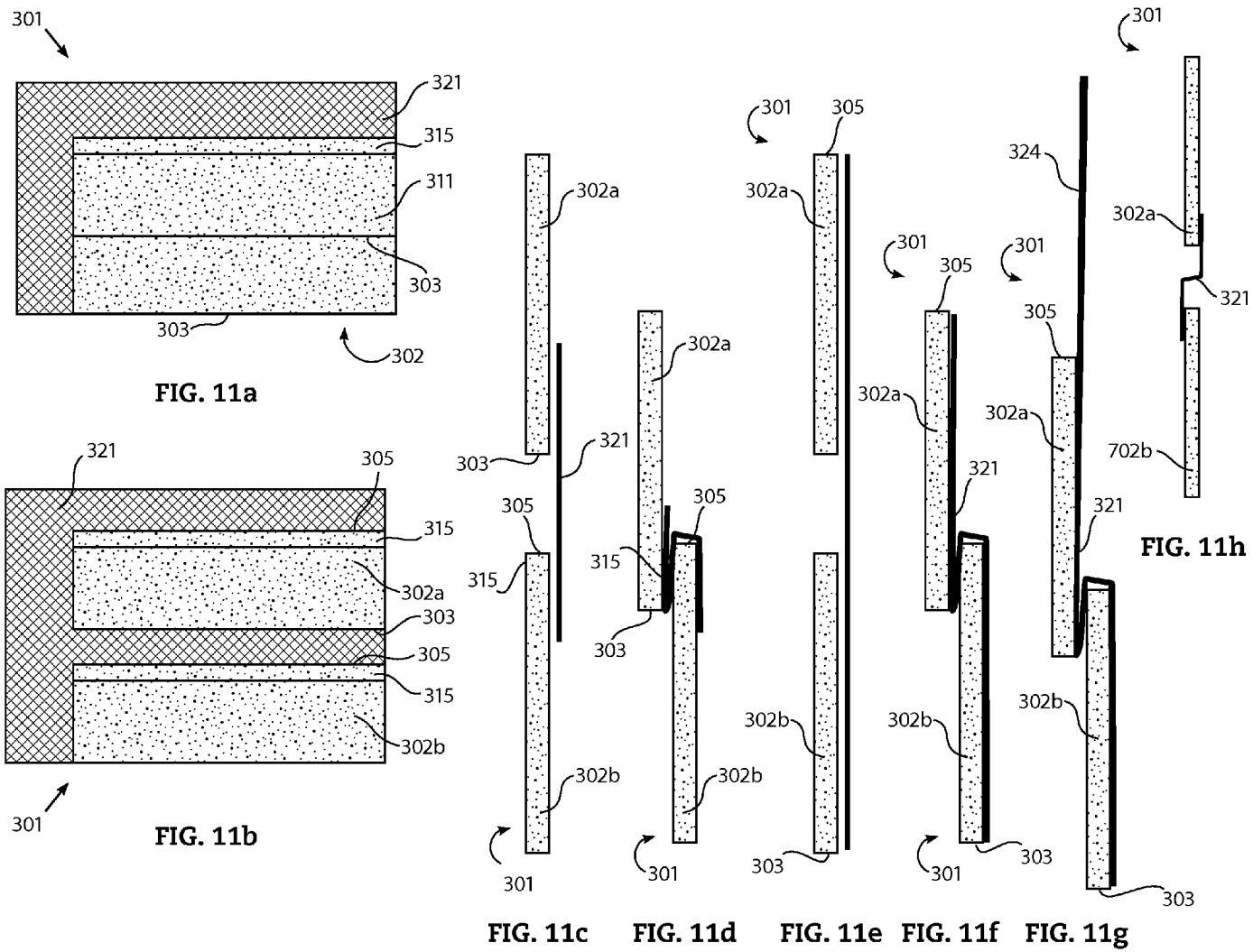

In some embodiments the shingle body 302 is provided with more than one course exposure zone 311 relative to conventional shingles. FIG. 11*a* shows a shingle body 302 having a double exposure zone 311, a fastening zone 315 and a top and side lap feature provided by a water impermeable sheet 321 attached to the shingle body 302. In one aspect the larger format shingle body 302 is provided by attaching the two courses to one another with an appropriate adhesive, where an adhesive is located in what would be the fastening zone 315 of the lower course shingle 302*b* that attaches to lower butt end 303 of the upper course shingle 302*a* so that a shingle 301 comparable to two courses results. In another case, the back sheet of a laminated shingle body is a common layer of shingle body material and the upper course is an added aesthetic treatment that could include another layer of shingle material. In some instances, the water impermeable sheet 321 extends fully to the butt edge 303 of the lower course shingle body 302*b*.

FIG. 11*b* shows an embodiment where a pair of shingle bodies 302*a*, 302*b* are arranged as one shingle body above the other and a connector sheet (e.g., a foldable water impermeable sheet) 321 or other structure connects the two shingle bodies 302*a*, 302*b*. In FIG. 11*c*, a connector sheet 321 may be attached to the back of the lower portion 302*b* near the butt edge 303 of the upper shingle body 302*a* and the back of the upper portion near the head edge 305 of the lower shingle body 302*b*. The foldable, and in some cases flexible, sheet 321 allows the upper shingle 302*a* to be brought forward and down so that the butt end 303 of the upper shingle body 302*a* overlies the fastening zone 315 of the lower shingle body 302*b* to present a two course exposure shingle 301 as depicted in FIG. 11*d*. Such a foldable aspect of the connector sheet 321 in this embodiment allows the lower shingle body 321*b* of the dual course shingle 301 to be securely fastened to the roof via its fastening zone 315 prior to bringing the upper course shingle body down and into place. The connector sheet 321 prevents moisture intrusion between the upper and lower shingle bodies 302*a*, 302*b* of the dual course shingle 301. An optional sealant may be employed to further secure the upper and lower shingle bodies 302*a*, 302*b*. Such a sealant may be provided on the connector sheet 321 so that when folded in place, the sealant engages the fastening zone of the lower shingle body 302*b*. Alternatively, the optional sealant may be provided in the fastening zone 315 of the lower shingle body 302*b* so that when the upper shingle body 302*a* is brought into position the sealant assists in securing it in place in addition to fasteners through the fastening zone 315 of the upper shingle body 302*a* holding the shingle 301 in place on the roof.

FIGS. 11*e* and 11*f* show a similar shingle 301 where the connector sheet 321 extends upwardly to proximate the head edge 305 of the upper shingle body 302*a* and downwardly to proximate the butt edge 303 of the lower shingle body 302*a*. FIG. 11*g* is similar to 11*f*, but further includes an upwardly directed extension 324 of the connector sheet 321 beyond the head edge 305 of the top shingle body 302*a* to form the top lap portion of the water impermeable sheet 321. FIG. 11*h* illustrates an embodiment where the water impermeable sheet 321 overlays one of the two or more courses (e.g., the lower course 302*b*) and underlays the other of the two or more courses (e.g., the upper course 302*a*), while joining the two courses together as a single roofing shingle 301 that simulates two courses. It will be understood that FIG. 11 is a side edge view and the side lap extension beyond the first side edge 307 of the shingle body 302 is not depicted.

It will be understood that the portion of the water impermeable sheet 321 may extend beneath the shingle body 302 as described above with reference to FIGS. 3, 4 and 10. Further, the water impermeable sheet 321 may include a reinforcement so that a level of improved wind resistance and/or impact resistance is provided as described in U.S. Pat. No. 7,537,820 and its patent family. In one embodiment the reinforcement is a part of the water impermeable sheet itself. In another embodiment the reinforcement is made up of an additional sheet built into the roofing product construction.

Figures 12A, 12B, 12C, 12D, 12E, 12F:
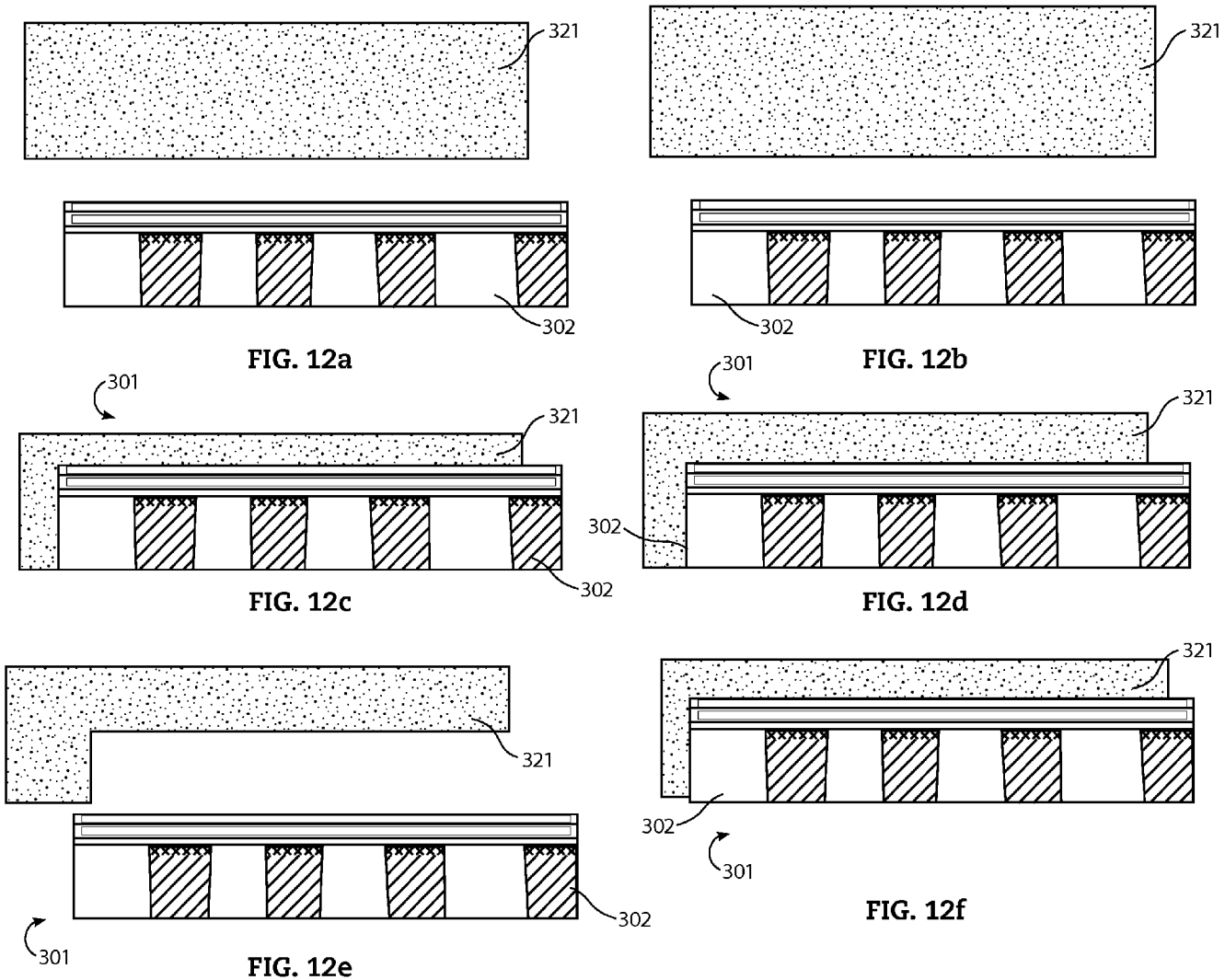

FIGS. 12 *a* and *b* depict separate components of water impermeable sheets 321 and shingle bodies 302. The water impermeable sheets 321 have widths similar to the shingle body 302 and, as shown in FIGS. 12 *c* and *d*, are attached to the shingle body 302 with a lateral offset to provide top and side lap extensions to close the roof when such shingles 301 are laid thereon. In FIG. 12*e*, an alternative water impermeable sheet 321 is shown that uses less material yet still provides the top and side lap features in FIG. 12*f* necessary to close the roof.

Figure 13B:
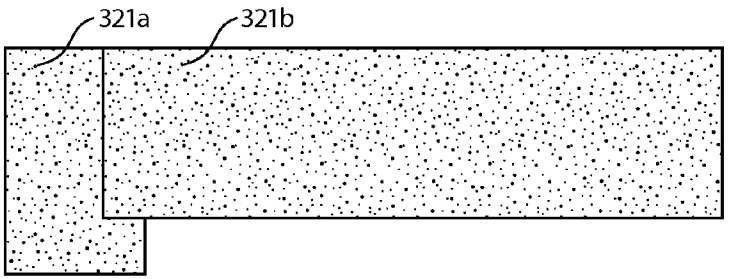
Figure 13A:
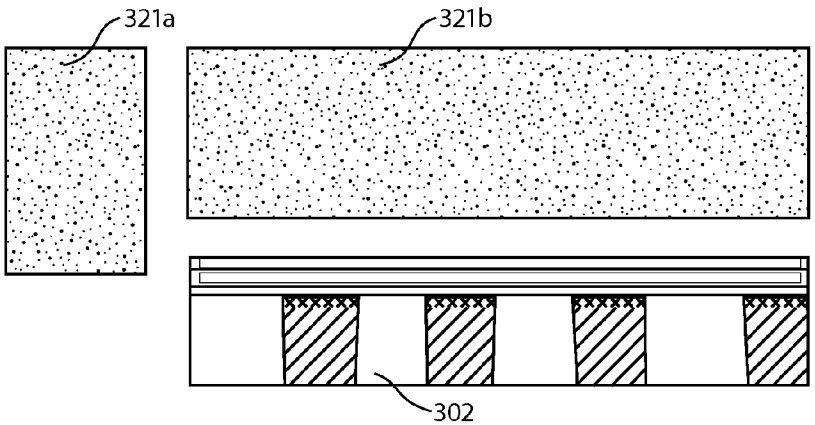
Figure 13D:
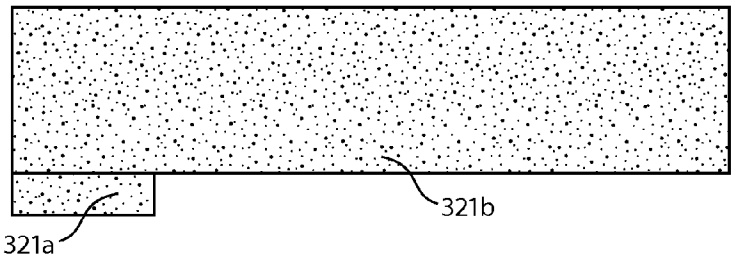
Figure 13C:
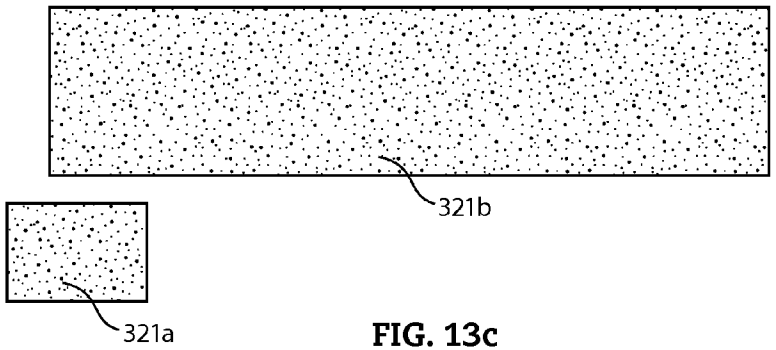

FIG. 13*a* shows separate components of water impermeable sheets 321*a*, 321*b* and shingle bodies 302 where the water impermeable sheets 321*a*, 321*b* are made up of two pieces, a first one 321*b* to provide the top lap feature and a second one 321*a* to provide the side lap feature. FIGS. 13*b, c* and *d* provide alternate embodiments for assemblies of composite water impermeable sheets 321*a*, 321*b*.

Figure 14A:
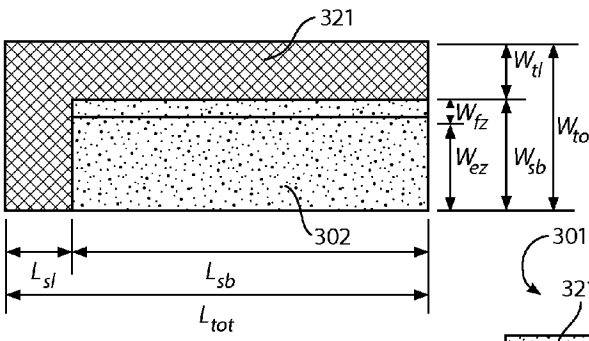
FIGS. 14*a*-14*c*, 15*a*-15*b*, 16*a*-16*b* and 17*a*-17*b* are plan views depicting installation of courses of embodiments of shingles.
Figure 14B:
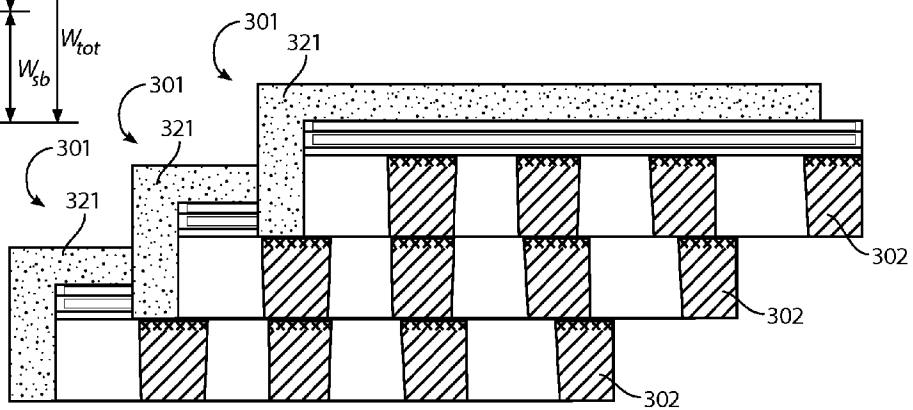
Figure 14C:
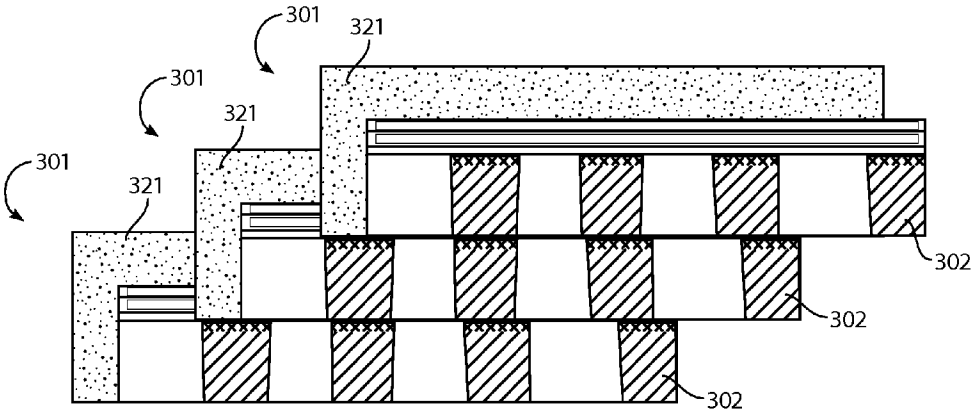
Figure 15A:
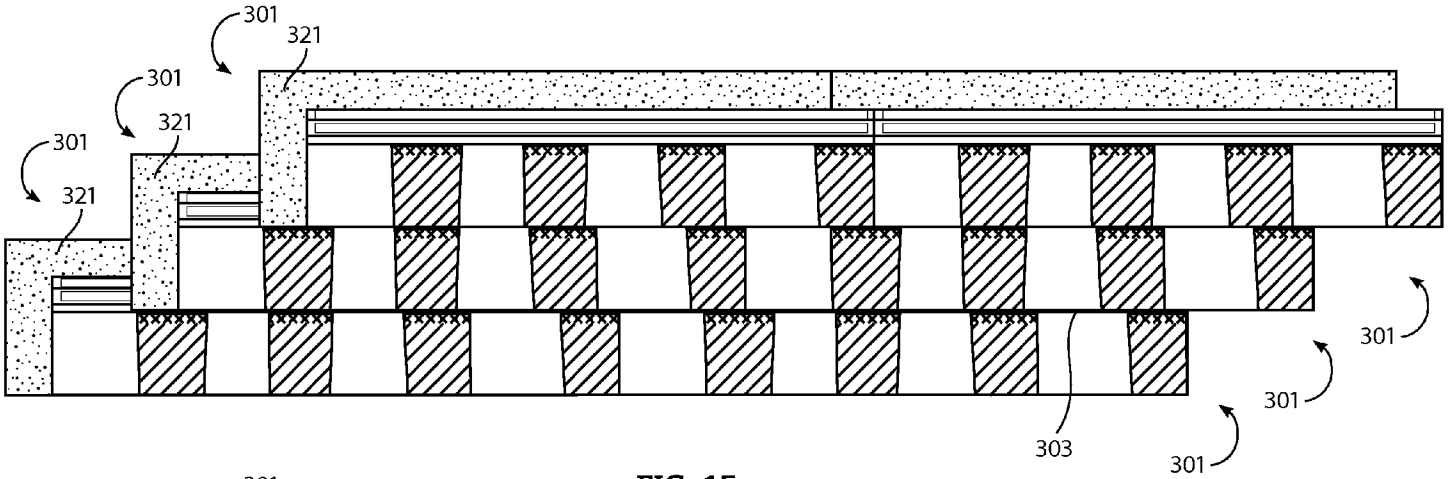
Figure 15B:
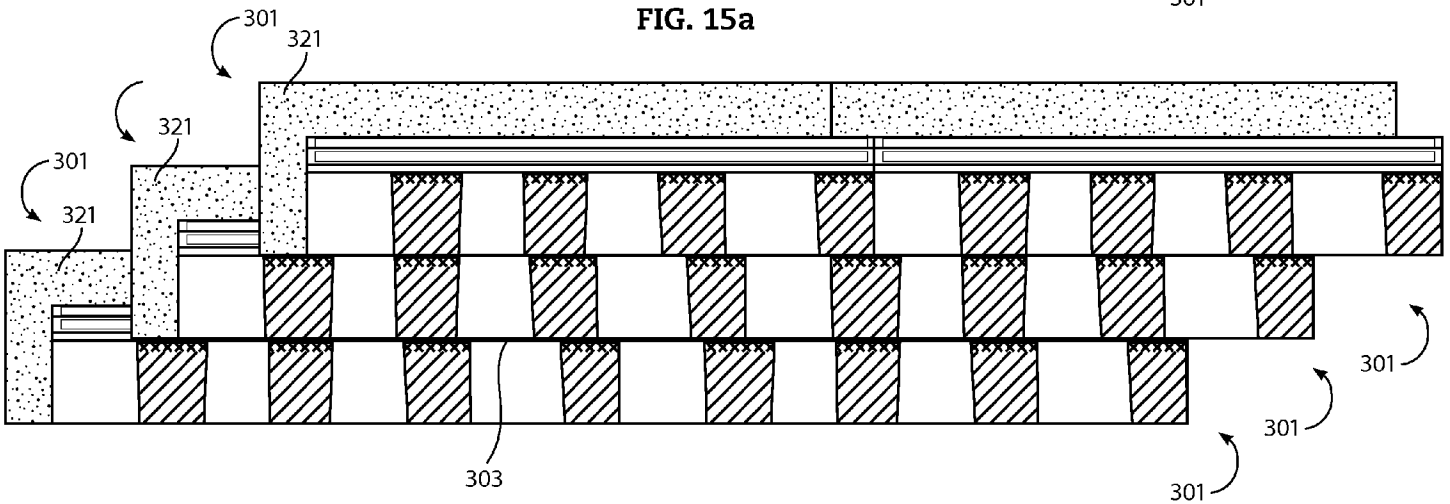

FIG. 14 shows three shingles 301 having shingle bodies 302 with an aesthetic look similar to that of the FIG. 1*c* with removed headlap material, and water impermeable sheet 321 top and side lap portions arranged in overlapping shingle fashion with a lateral offset as they may be installed upon a roof. FIG. 15 shows an additional set of three such shingles 301 arranged so that there are three courses of two shingles 301, the courses being laterally offset from one another and the top lap portion of the shingles 301 in a given course being overlaid by the exposure zone of the first overlying course of shingles 301 and also being overlaid by the butt edge 303 of the second overlying course of shingles, and the side lap portion being overlaid by a laterally adjacent shingle 301 within the same course. The top and side lap portions 321 provide coverage to the roof under the joints between adjacent shingle bodies 302 such that any moisture intrusion between the joints would be directed down the roof and the roof would be closed.

Figure 16A:
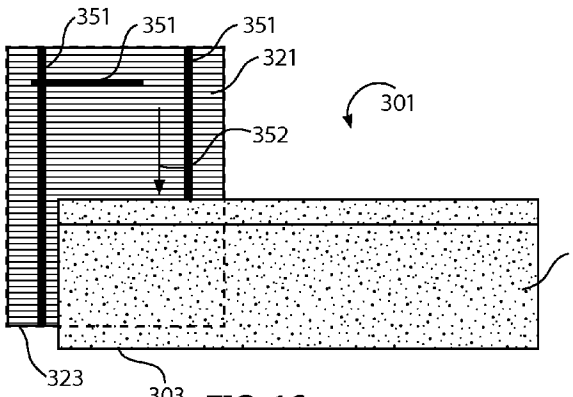
Figure 16B:
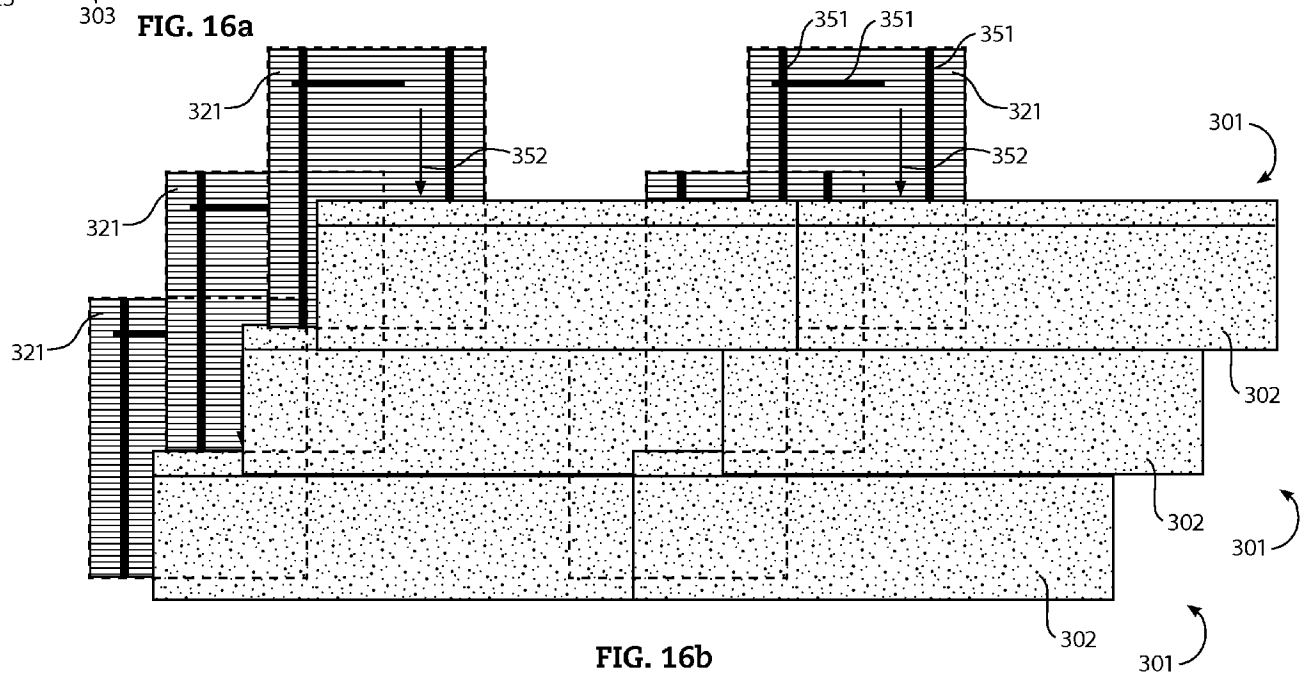
Figure 17A:
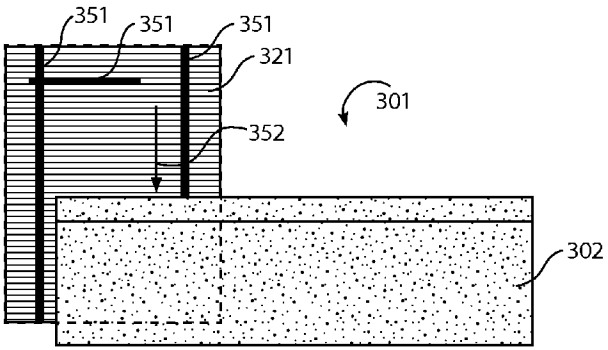
Figure 17B:
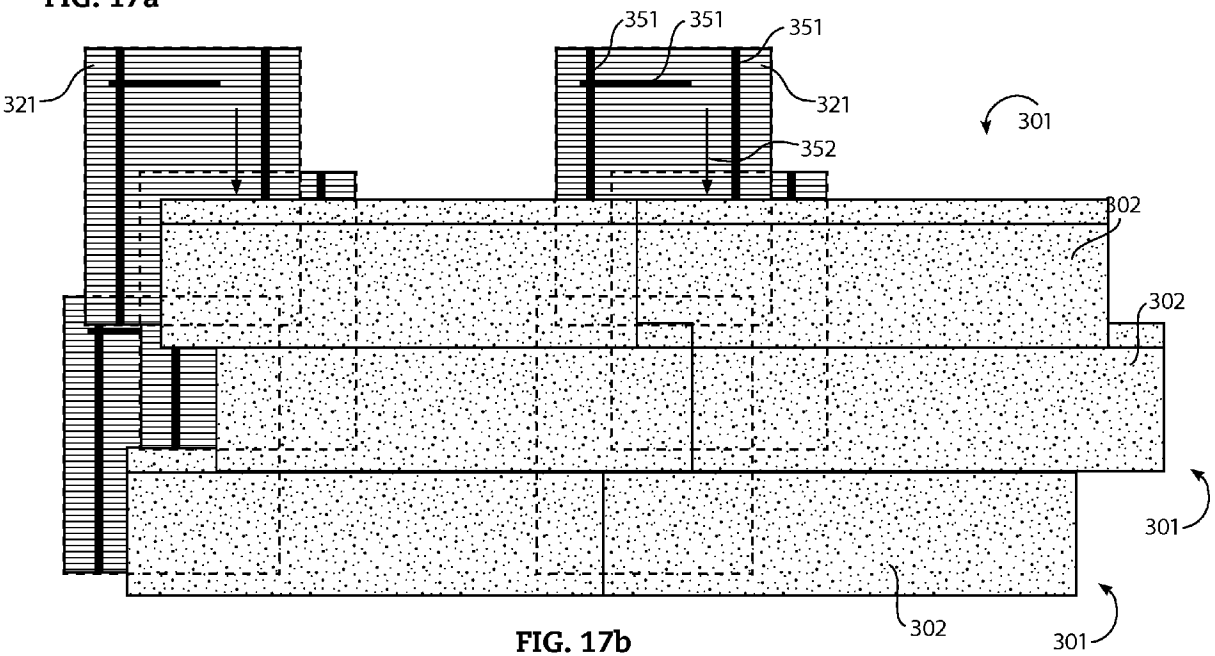
Figure 20D:
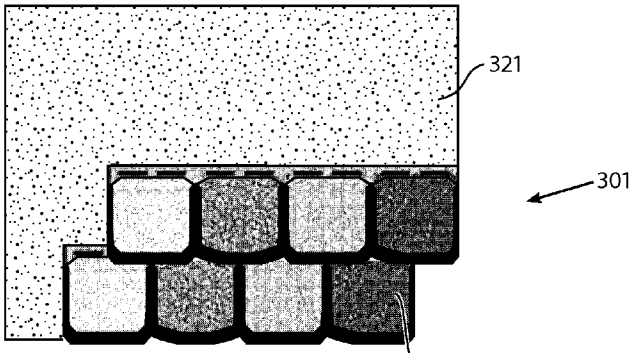
FIGS. 20*a*-20*e* are plan views depicting installation of courses of embodiments of shingles.
Figure 20A:
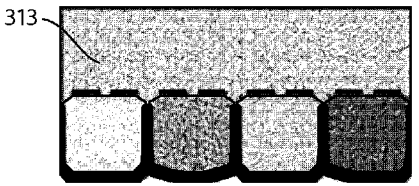
Figure 20B:
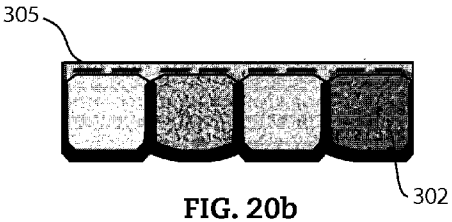
Figure 20C:
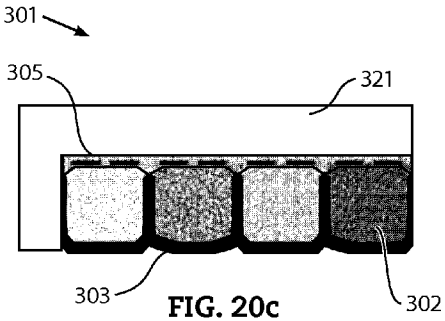
Figure 20E:
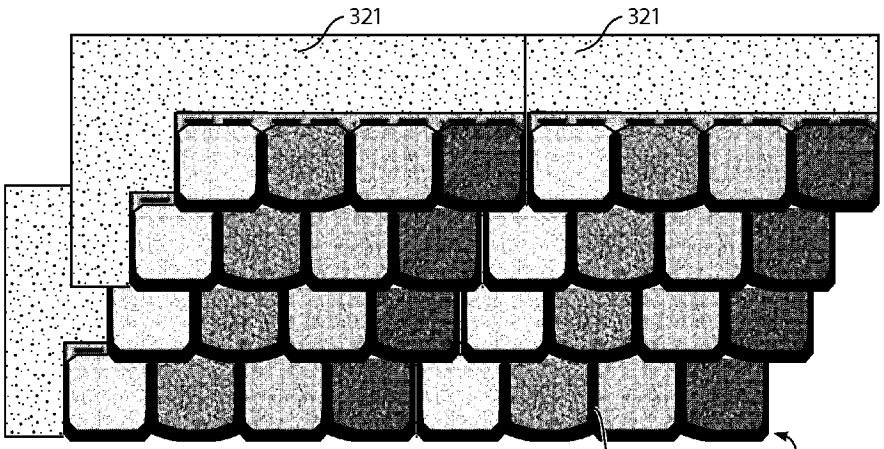

FIG. 16 shows an embodiment that is an alternate to those of FIG. 5, where the length of the water impermeable sheet 321 is less than that of the shingle body 321. Lines of adhesive sealant 351 are provided on the water impermeable sheet 321 around the perimeter near the outer portions of its contact with an adjacent or overlying shingle 301. The lower edge 323 of the water impermeable sheet 321 is offset from the butt edge 303 of the shingle body 302. A visual indicator arrow 352 is provided to aid in placement of an overlying shingle 301 such the gap between adjacent shingles 301 is closed during installation on a roof in a stair step fashion with each successive course of shingles 301 laterally offset in the same direction. In FIG. 17, the same shingle 301 is shown with installation in a racked fashion on a roof. The second course is laterally offset to the right and the third course is aligned vertically with the first course. By making use of the visual indicator arrow 352 for proper placement of the shingles 301 in the installation, closure of the roof between laterally adjacent shingles 301 is achieved.

FIGS. 18*a* through 18*f* show components for a shingle 301 including a water impermeable sheet 321 top and side lap portion, and a laminated shingle body 302 having a fastening zone 315 and an exposure zone 311. FIG. 18*g* shows such a shingle 301 assembled. In some embodiments, as described above, the water impermeable sheet 321 may be located near a head edge 305 of the shingle body 302, extend downward from the head edge 305 and terminate not far from the head edge 305 of the shingle body 302 near its attachment thereto. Optionally the side lap portion water impermeable sheet 321 may be present well lower than the head edge 305 behind the shingle body 302, even in some instances having a width that allows it to cover the entire back of the shingle body 302 or longer, having a length equal to Wtot for the shingle 301.

FIGS. 18*b* through *f* are side edge schematic views of various configurations of a water impermeable sheet 321 and a side edge schematic view of a shingle body 302. FIG. 18*b* shows a z-fold arrangement 391 of the sheet where the open downward facing portion of the z-shape 391 in the figure receives the head edge 305 of the shingle body 302. FIG. 18*c* shows an alternative z-shape 391 where the sheet 321 includes sufficient material so that its width extends downwardly to the butt edge 303 of the shingle body 302 when the shingle 301 is assembled. FIG. 18*d* shows a side edge view of the sheet 321 where the sheet 321 extends partially down the back of the shingle body 302. FIG. 18*e* shows a simple flat sheet structure 321 of sufficient width to allow attachment to either the front or the back of the shingle body 302 near the head edge 305 of the shingle body 302. FIG. 18*f* shows a sheet 321 of sufficient width to extend downward toward the butt edge 303 of the shingle body 302 when assembled.

FIGS. 18*h* through 18*r* depict side edge views of various arrangements of water impermeable sheets 321 and shingle bodies 302 in assembled shingles 301. In FIGS. 18*h* through 18*l*, the water impermeable sheet 321 is disposed close to substantially the same plane as the front surface of the shingle body 302. In FIG. 18*l* the water impermeable sheet 321 is attached to the front face of the shingle body 302 near the head edge 305. The shingle 301 of FIG. 18*h* has the sheet 321 attached to the head edge 305 of the shingle body 302. The shingle 301 of FIG. 18*h* has a receiver portion 391 of the water impermeable sheet 321 attached to the head edge 305 of the shingle body 302 with a portion extending onto the front face of the shingle body 302 near the head edge 305 and another portion extending onto the rear of the shingle body 302 near the head edge 305. The shingle 301 of FIG. 18*i* has an extension of the sheet 321 that covers the fastening zone 315 of the shingle body 302 and a portion attached to the head edge 305 of the shingle body 302. In FIG. 18*j*, the sheet 321 also has a portion 391 to receive the shingle body 302 that wraps around to the rear surface of the shingle body 302 near the upper edge 305. In the shingle of FIG. 18*k*, the sheet 321 extends down to the butt edge 303 of the shingle body 302 on the rear of the shingle 301.

In FIGS. 18*m* and 18*n*, the water impermeable sheet 321 is disposed close to substantially the same plane as the rear surface of the shingle body 302. In FIG. 18*m* the water impermeable sheet 321 is attached to the rear surface of the shingle body 302 near the head edge 305. In the shingle 301 of FIG. 18*n*, the sheet 321 extends down to the butt edge 303 of the shingle body 302 on the rear of the shingle 301.

FIGS. 18*o*, 18*p*, 18*q* and 18*r* depict embodiments where the shingle body 302 is of laminate structure and at least a portion of the water impermeable sheets 321 is attached to the shingle body 302 between two parts of the laminate structure 302. In FIG. 18*o*, the sheet 321 is near the plane of the front surface of the shingle body 302 with portions extending to the front surface near the head edge 305 and portions wrapping around the head edge 305 of the front most layer of the laminate structure 302 and between the lamina near the head edge 305 of the shingle body 302. In FIG. 18*p*, a shingle 301 is depicted with the sheet 321 attached to the head edge 305 of the rear layer of the laminated shingle body 302 with a portion extending between the upper edges 305 of the layers 302 near the head edge 305 and the sheet 321 aligned in a plane between the layers of the laminated shingle body 302. In FIG. 18*q*, the shingle 301 has the water impermeable sheet 321 attached between the upper edges 305 of the laminated shingle body 302. In FIG. 18*r*, the water impermeable sheet 321 is disposed between the layers of the laminated shingle body 302 and extends downwardly to the butt edge 303 of the shingle 301.

FIG. 19*a* through 19*i* show alternative examples where the top lap extension 321 is less than that of FIGS. 18. It will be understood that a variety of approaches may be used to bond or adhere the top and side lap material 321 to the shingle body 302 including adhesives, sealants, welds, or the like. Mechanical fasteners are also useful for affixing the water impermeable sheet 321 to the shingle body 302.

In one aspect the water impermeable sheet 321 is constituted of a material and is attached to the shingle body 302 in a manner such that it remains substantially in the general plane of the shingle 301 during handling and installation. In another aspect, the sheet 321 is foldable such that it may be folded forward toward the front surface of the shingle body 302, for example for packaging or shipping in more compact form. In yet another aspect the sheet 321 may be folded backwardly toward the rear of the shingle 301. FIG. 19*j* through 19*n* show some embodiments with foldable structures 321 for the wind resistant sheet, with 19*l* and 19*n* showing deployment of adhesive sealant 351 on the shingles 301. Additional sealants 351 disposed near the lower edge of the front surface of the top lap of water impermeable sheet material 321 and near the upper edge 305 of the shingle body 302 can assist in closing the shingle installation on the roof. In one embodiment of a shingle 301 having a foldable top lap sheet 321 and a line of sealant 351 thereon, a release tape is provided on the front surface of the shingle body 302 where the sealant 351 would otherwise meet the shingle surface when folded to prevent blocking of the folded top lap 321 in place. Alternatively, if the sealant 351 is on the shingle body 302, a release strip may be incorporated into the top lap construction to meet the sealant 351 to prevent blocking during storage or transport, yet allow the sealant 351 to enhance the bond between adjacent courses of shingles 301 on the roof. FIG. 19*n* depicts an embodiment where a sealant 351 is disposed on the rear surface of the shingle body 302 near the butt edge 303 of the shingle 301. As noted above, complementarily located release materials may be provided so that in a folded or unfolded state, or in a packaged state, sealant lines or strips will be aligned with release material that will prevent sticking between shingles or shingle components at undesired stages of their use.

FIG. 20 shows examples of another type of shingle 301 where a water impermeable sheet 321 top and side lap portion can be used to provide a shingle 301 having the appearance of a conventional shingle or shingles, yet take advantage of constructions that employ lesser amounts of conventional shingle materials. FIG. 20*a* shows a top view of a product commercially available as Centennial Slate™, available from CertainTeed Corporation, Valley Forge, Pa. FIG. 20*b* shows a shingle body 302 with a portion of the headlap 313 omitted relative to the conventional shingle of FIG. 20*a*. FIG. 20*c* shows a shingle 301 with reduced headlap portion equipped with a water impermeable sheet 321 top and side lap portion. FIG. 20*d* shows a two course look shingle 301 with a top and side lap portion 321. The two course shingle bodies 302 are laterally offset in the shingle 301. FIG. 20*e* shows an array of the two course embodiment of FIG. 20*d*.

The water impermeable sheet making up at least the top and side lap portion of the shingle can be composed of a variety of different materials. In one aspect it is made up of materials used in conventional roofing membranes such as EPDM or TPO thermoplastic or bituminous membranes commonly used on low slope roofs. In another aspect it is made up of materials such as roofing underlayments such as asphalt coated felt, non-asphaltic fiberglass underlayments or synthetic underlayments. Exemplary synthetic underlayments include, but are not limited to TITANIUM™ synthetic roofing underlayment from InterWrap, Mission, British Columbia, Canada, Tri-Flex® from Grace Construction Products, Cambridge, Mass., Summit® Synthetic Underlayment from Atlas Roofing Corporation, Atlanta, Ga., and the like. In a further aspect the top and side lap material is made up of a bituminous underlayment material such as one of the WinterGuard™ family of products available from CertainTeed Corporation, Valley Forge, Pa.

In another aspect the water impermeable sheet can be made of a plastic film or sheet of appropriate size, shape, thickness and flexibility to act as a side lap portion of the shingle. Suitable polymers making up such a film or sheet include acrylic sheet, polyvinylchloride sheet, nylons, polyimides, polyurethanes, polyureas, polyolefin copolymers and ionomers, and the like. The films or sheets may be coextruded with protective layers. For example, a polyvinylchloride sheet may include a layer of ASA or AES on the top surface of the top and side lap portion. The sheet may be flexible or rigid. Polymer coated fabrics may also be employed.

In some embodiments a protective coating of high durability is provided for zones that may experience some exposure to the elements, such as, for example, in the area of the top surface of the top and side lap portion where pairs of adjacent overlying shingles will meet to form joints in the roof covering. In certain embodiments, printed areas are used on the top and side lap to indicate lateral offset of shingles to be installed in an overlying course, the portions of the top and side lap that will underlie the joints being stabilized to weather to a greater extent than other portions of the top and side lap. In other embodiments, the entire top surface of the top and side lap is so stabilized. Suitable materials for such protective treatments include fluoropolymer coatings such Kynar based coatings, acrylic coatings, polyurethanes, acrylic urethanes, and the like.

In some embodiments the water impermeable sheet includes a metal foil or sheet. In further embodiments, the impermeable sheet includes a metallized polymer film or sheet, such as, for example a metallized polyester sheet.

Further, the water impermeable sheet can be provided with or without reinforcements of glass, polymeric, carbon or ceramic fibers. The water impermeable sheet can include polymers reinforced with nanomaterials such as nanoparticulate fillers or nanofibers. A fabric-like reinforcement may make up a portion of the water impermeable sheet, such as a woven, a nonwoven, a spunbond, a knitted, a netted, or scrim fabric web or sheet.

Additional ingredients suitable for inclusion in the water impermeable sheet include additives such as colorants, UV stabilizers, thermal stabilizers, antioxidants, antimicrobials and fire retardants. Flame retardants are materials that inhibit or resist the spread of fire. These can be separated into several categories:

- Minerals such as asbestos, compounds such as aluminum hydroxide, magnesium hydroxide, antimony trioxide, various hydrates, red phosphorus, and boron compounds, mostly borates.
- Tetrakis (hydroxymethyl) phosphonium salts, made by passing phosphine gas through a solution of formaldehyde and a mineral acid such as hydrochloric acid, are used as flame retardants for textiles.
- Synthetic materials such as halocarbons. These include organochlorines such as polychlorinated biphenyls (PCBs), chlorendic acid derivates (most often dibutyl chlorendate and dimethyl chlorendate) and chlorinated paraffins; organobromines such as polybrominated diphenyl ether (PBDEs), which be further broken down into pentabromodiphenyl ether (pentaBDE), octabromodiphenyl ether (octaBDE), decabromodiphenyl ether (decaBDE) and hexabromocyclododecane (HBCD). Synthetic flame retardant materials also include organophosphates in the form of halogenated phosphorus compounds such as tri-o-cresyl phosphate, tris(2,3-dibromopropyl) phosphate (TRIS), bis(2,3-dibromopropyl) phosphate, tris(1-aziridinyl)-phosphine oxide (TEPA), and others.

Flame retardants can have various mechanisms of function to retard progress of flames and burning of compositions including them. For example, some compounds break down endothermically when subjected to high temperatures. Magnesium and aluminum hydroxides are an example, together with various hydrates, such as alumina trihydrate. The reaction removes heat from the surrounding, thus cooling the material. Care is needed with such flame retardants during processing so as to remain below the decomposition temperature while a product is being manufactured. An alternative mechanism for flame retardance is the dilution of fuel. Inert fillers such as talc or calcium carbonate, act as diluents, lowering the amount of the combustible portion of the material, thus lowering the amount of heat per volume of material that can be produced while burning. Other flame retardants can act through a thermal shielding mechanism. A way to stop spreading of the flame over the material is to create a thermal insulation barrier between the burning and unburned parts. Intumescent additives can be employed to turn the polymer into a carbonized foam, which separates the flame from the material and slows the heat transfer to the unburned fuel. Yet another mechanism for flame retardant action is the dilution of gas phase reactants in the flame. Inert gases such as carbon dioxide and water produced by thermal degradation of some materials act as diluents of the combustible gases, lowering their partial pressures and the partial pressure of oxygen, and slowing the reaction rate to inhibit burning. Still another mechanism for flame retardance is gas phase radical quenching. Chlorinated and brominated materials undergo thermal degradation and release hydrogen chloride and hydrogen bromide. These react with the highly reactive H. and OH. radicals in the flame, resulting in an inactive molecule and a Cl. or Br. radical. The halogen radical has much lower energy than H. or OH., and therefore has much lower potential to propagate the radical oxidation reactions of combustion. Antimony compounds tend to act in synergy with halogenated flame retardants.

In another aspect, the water impermeable sheet includes recycled content. In the case of polymeric based water impermeable sheet materials, the sheet can include various amounts of recycled post-consumer, pre-consumer, post-industrial or industrial waste polymeric materials from the waste stream. In the case of a bituminous membrane based water impermeable sheet, the sheet can include recycled shingle material from industrial sources, or even from shingle tear-off sources.

The water impermeable sheet is attached to the shingle body so as to provide a side lap portion to close the roof to moisture and the elements when it is installed on a roof. Various methods of attachment are suitable. Among such methods are the use of adhesives, sealants, and welds. Bituminous adhesives may be used to attach the sheet to the shingle body. Other adhesives include polyurethanes, epoxies, butyl adhesives, rubber resin adhesives, and the like. The adhesives may be reactive two part or one part adhesives. In some cases hot melt adhesives are employed. In still other cases, pressure sensitive adhesives may be used to bond the water impermeable sheet to the shingle body. Thermal, vibrational, sonic or other welding may be employed to fuse the parts together. Additionally, mechanical attachment methods may also be used in some embodiments to secure the water impermeable sheet and the shingle body one to another. Mechanical attachment approaches include mechanical fasteners, staples, sewing, stitching, rivets, grommets, and the like.

Top and side lap treatments and arrangements have been described that allow the manufacture and provision of functional shingles having the look and appearance of conventional shingles, yet make use of lower quantities of conventional shingle material by way of reduction of the volume of headlap material employed in an asphaltic or bituminous shingle. Structured elements incorporated in the top and side lap portion include ridges, troughs, curls, flanges, and other shapes varied dimension that act to provide barriers, channels and pathways for water that may intrude between adjacent shingles on the roof and direct the water downwardly to pass over the lower shingles on the roof as the roof drains. Sealants are also useful features that can be included in continuous, discontinuous, and chevroned fashion in the shingle construction. Multiple dams of sealant can be used. In one embodiment, the back of the water impermeable sheet includes full coverage of a sealant or adhesive for bonding the shingle to the roof deck. The attachment of the water impermeable sheet material can be made to the bottom of the shingle body, or via interlamination between layers of a laminated shingle body. In some instances, the sheet imparts a degree of impact resistance to the shingle body. The water impermeable sheet can be composed of different materials having different functionality as needed beneath the exposure zone of the shingle or in the attachment zone.

Some embodiments of a roofing shingle may comprise a shingle body comprising a buttlap portion with a butt edge and a headlap portion with a head edge, a first side edge and a second side edge, an exposure zone extends from the butt edge toward the headlap portion and is configured to be exposed to the environment when the shingle is installed on a roof; and a water impermeable sheet (WIS) attached to the shingle body, the WIS having a width, length, first end and second end, the width extends from between about the butt and head edges to beyond the head edge of the shingle body, the length extends from between about the first and second side edges to beyond the first side edge, and the WIS is formed from a different material than the shingle body.

The first end of the WIS may extend beyond the first side edge, such that a first distance between the first end and the first side edge is at least about 10% of a second distance between the first end of the WIS and the second side edge; and an upper edge of the WIS may extend beyond the head edge of the shingle body by a third distance, and the third distance may be greater than or equal to the first distance.

The WIS may be permanently attached to the shingle body, and the length of the WIS may extend beyond the first side edge of the shingle body by at least about 2 inches, at least about 4 inches, at least about 6 inches, or at least about 8 inches. The length of the WIS may extend approximately to the second side edge of the shingle body, and the second end of the WIS is proximal to the second side edge of the shingle body. The second end of the WIS may be offset from the second side edge of the shingle body by an amount comparable to an extension of the first end of the WIS beyond the first side edge of the shingle body. The length of the WIS may be greater than the width of the WIS and the length is greater than half of a length of the shingle body, or the length of the WIS may be less than the width of the WIS and the width is greater than width of the shingle body. The headlap portion may have a width that is less than a width of the exposure zone. The width of the WIS may extend downwardly approximately to the butt edge of the shingle body, and a lower edge of the WIS may be proximate the butt edge of the shingle body. A lower edge of the WIS may be offset upwardly from the butt edge of the shingle body. The upward offset may be an amount less than a width of the exposure zone of the shingle body.

The shingle body may emulate two or more courses of conventional shingles. The roofing shingle may be selected from the group consisting of: the two or more courses are secured to each other with an adhesive, wherein the WIS is foldable and connects the two or more courses, wherein the WIS is attached to backs of the two or more courses, wherein the WIS allows an upper course to overlay a lower course, wherein the WIS only overlays portions of the two or more courses, or wherein the WIS overlays entire surfaces of the two or more courses, and the WIS overlays one of the two or more courses and underlays the other of the two or more courses.

The WIS may be selected from the group consisting of: the width of the WIS extends beyond the head edge or beyond the butt edge of at least one of the two or more courses, the WIS has an extension that folds over at least one of the two or more courses, the two or more courses are laterally offset from each other, and the WIS has a shaped portion to accommodate the lateral offset of the two or more courses.

The WIS may comprise a structural element having a raised portion configured to provide a dam against moisture intrusion. The structural element may comprise a rigid structure. The structural element may be selected from the group consisting of: a raised ridge that is generally parallel to the first side edge of the shingle body, a plurality of ridges, a folded-over J-shaped flange, a folded-over J-shaped flange and a raised ridge between the flange and the first side edge of the shingle body, and a crimped structure such that no additional material is needed to create the structural element. The raised portion may be selected from the group consisting of: adjacent an upper edge and the first side edge of the WIS, adjacent a lower edge of a top lap area above the head edge of the shingle body and between the first end of the WIS and the shingle body, a wider raised feature near a lower edge of a top lap adjacent the head edge of the shingle body and around the first side edge of the shingle body, curves around the shingle body on a top surface of the WIS, and a second raised portion parallel to the raised portion.

The structural element may comprise a sealant. The sealant may be selected from the group consisting of: continuous, discontinuous, on a top surface of the WIS, a top surface of the shingle body, a back surface of the WIS, a back surface of the shingle body, a plurality of lines of sealant, arranged in a chevron-like pattern, and a combination thereof. The WIS may be attached to one or more of a front surface, a back surface and a side surface of the shingle body.

The roofing shingle may further comprise a reinforcement mounted to a lower surface of the shingle body beneath the exposure zone. The WIS may comprise a reinforcement in a portion beneath the exposure zone of the shingle body. The shingle body may comprise a single layer of shingle material or a laminate having a plurality of layers. The shingle body may comprise an asphaltic or bituminous material. The WIS may have a thickness that is less than about 50% of a thickness of the shingle body, less than about 40%, less than about 30%, less than about 20%, less than about 10%, or less than about 5% of the thickness of the shingle body. The WIS may only extend beyond the first side edge and the head edge of the shingle body. The WIS may not extend beyond the butt edge or the second side edge of the shingle body. In some versions, the WIS does not extend beyond the buttlap portion of the shingle body.

Embodiments of the WIS may be attached to a lower surface of the shingle body. The second end of the WIS may be offset inwardly from the second side edge of the shingle body by an amount comparable to the portion of the length of the WIS that extends beyond the first side edge of the shingle body. The WIS may comprise at least one of a rectangular shape, a trapezoidal shape, a sinusoidal side lap, a shape with rounded corners or an L-shape. The WIS may comprise a plurality of separate pieces of WIS, each of which is joined to the shingle body in an overlapping manner.

The WIS may comprise one or more of EPDM, TPO thermoplastic, bituminous membrane, asphalt-coated felt, non-asphaltic fiberglass underlayment, synthetic underlayment, bituminous underlayment material, plastic film, acrylic, polyvinylchloride, nylon, polyimide, polyurethane, polyurea, polyolefin copolymer or ionomer, ASA, AES, fluoropolymer, polyurethane, acrylic urethane, metal foil, metallized polymer film or a combination thereof. The WIS may comprise one or more of glass, polymeric, carbon or ceramic fiber, polymers reinforced with nanomaterial, woven, nonwoven, spunbond, knitted, netted or scrim fabric, colorant, UV stabilizer, thermal stabilizer, antioxidant, antimicrobial, fire retardant, recycled content or a combination thereof.

The WIS may be attached to the shingle body with one or more adhesive, sealant, weld, mechanical attachment or a combination thereof. The WIS may be selected from the group consisting of: a z-fold arrangement with a z-shape, the z-shape has an open downward facing portion in which a head edge of the shingle body is located, the z-shape includes sufficient material to extend downwardly to the butt edge of the shingle body, the sufficient material only extends partially down a back of the shingle body, disposed in substantially a same plane as a front surface of the shingle body, attached to a front face of the shingle body near the head edge, attached to the head edge, a receiver portion attached to the head edge with a portion extending onto a front face of the shingle body near the head edge and another portion extending onto a rear of the shingle body near the head edge, an extension that covers a fastening zone of the shingle body and a portion attached to the head edge, a portion to receive the shingle body that wraps around to a rear surface of the shingle body near the upper edge, extends down to the butt edge of the shingle body on a rear of the shingle, disposed in substantially a same plane as a rear surface of the shingle body, attached to a rear surface of the shingle body near the head edge, extends down to the butt edge of the shingle body on a rear of the shingle, wherein the shingle body is a laminate structure and at least a portion of the WIS is attached to the shingle body between two parts of the laminate structure, approximately in a plane of a front surface of the shingle body with portions extending to a front surface near the head edge and portions wrapping around the head edge of a front most layer of the laminate structure and between the lamina near the head edge of the shingle body, attached to the head edge of a rear layer of the laminate structure with a portion extending between upper edges of the layers near the head edge and the WIS is substantially aligned in a plane between layers of the laminate structure, attached between upper edges of the laminate structure, and disposed between layers of the laminate structure and extends downwardly to the butt edge.

Embodiments of a method of making a roofing shingle may comprise forming a shingle body with a buttlap portion and a butt edge, a headlap portion and a head edge, a first side edge and a second side edge, an exposure zone extending from the butt edge toward the headlap portion that is configured to be exposed to the environment when the shingle is installed on a roof; and a attaching a water impermeable sheet (WIS) to the shingle body, the WIS having a width, length, first end and second end, the width extends beyond the head edge, the length extends beyond the first side edge, and the WIS is formed from a different material than the shingle body. The attaching may comprise attaching the WIS to the shingle body after the shingle body is fabricated, or attaching the WIS to the shingle body while the shingle body is being fabricated.

The shingle body may emulate two or more courses of conventional shingles. Attaching may be selected from the group consisting of: securing the two or more courses to each other with an adhesive, wherein the WIS is foldable and connecting the two or more courses, attaching the WIS to backs of the two or more courses, overlaying a lower course with an upper course with the WIS, overlaying only portions of the two or more courses with the WIS, overlaying entire surfaces of the two or more courses with the WIS, and overlaying one of the two or more courses and underlaying the other of the two or more courses with the WIS. Attaching also may be selected from the group consisting of: extending the width of the WIS beyond the head edge or beyond the butt edge of at least one of the two or more courses, extending the WIS to fold over at least one of the two or more courses, laterally offsetting the two or more courses from each other, accommodating a lateral offset of the two or more courses with a shaped portion of the WIS, and forming an asphaltic component on a top surface of the WIS and using the asphaltic component to align the WIS with the shingle body.

In still other embodiments, a method of installing roofing shingles may comprise providing a plurality of roofing shingles, each shingle having a shingle body, a water impermeable sheet (WIS) attached to the shingle body and extending therefrom as a sidelap and as a headlap, and the WIS is formed from a different material than the shingle body; and fastening the roofing shingles to a roof deck with fasteners in horizontal courses such that adjacent ones of the shingle bodies in a single horizontal course only laterally abut each other, only overlap adjacent WIS, and do not overlap each other.

The method may further comprise extending the WIS from the shingle body only as the sidelap and not as a headlap, extending at least some of the fasteners through the WIS as well as the shingle bodies, fastening the roofing shingles directly to the roof deck with no underlayment between the roofing shingles and the roof deck, or laterally abutting the shingle bodies of the roofing shingles to each other such that the shingle bodies do not overlap each other, and the shingle bodies only overlap the WIS.

All patents and patent applications noted in this disclosure are incorporated by reference.

It will be apparent to those skilled in the art that various modifications and variations can be made to the present invention without departing from the scope of the invention. Thus, it is intended that the present invention cover the modifications and variations of this invention provided they come within the scope of the appended claims and their equivalents.

What is claimed is:

1. A roofing shingle, comprising:

a shingle body comprising a buttlap portion with a butt edge and a headlap portion with a head edge, a first side edge and a second side edge, an exposure zone extends from the butt edge toward the headlap portion and is configured to be exposed to the environment when the shingle is installed on a roof, and the shingle body comprises an asphaltic or bituminous material; and a water impermeable sheet (WIS) permanently attached to the shingle body prior to installation of the roofing shingle on a roof, the WIS having a width, length, first end and second end, the width extends from between about the butt and head edges to beyond the head edge of the shingle body to define a headlap, the length extends from between about the first and second side edges to beyond the first side edge to define a sidelap, a lower edge of the WIS is offset from the butt edge of the shingle body such that the WIS width is less than a total width of the shingle body, and the WIS comprises a polymer.

2. The roofing shingle of claim 1, wherein the first end of the WIS extends beyond the first side edge, such that a first distance of the sidelap between the first end and the first side edge is at least about 10% of a second distance between the first end of the WIS and the second side edge; and an upper edge of the WIS extends beyond the head edge of the shingle body by a third distance of the headlap, and the third distance is greater than or equal to the first distance.

3. The roofing shingle of claim 1, wherein a length of the sidelap extends beyond the first side edge of the shingle body by at least about 4 inches.

4. The roofing shingle of claim 1, wherein the second end of the WIS is offset from the second side edge of the shingle body by an amount comparable to an extension of the first end of the WIS beyond the first side edge of the shingle body.

5. The roofing shingle of claim 1, wherein the headlap portion has a width that is less than a width of the exposure zone, and the headlap of the WIS has a width that is less than the width of the exposure zone.

6. The roofing shingle of claim 1, wherein the shingle body comprises a pair of shingle bodies, the WIS is a single substrate attached to both shingle bodies, and the pair of shingle bodies emulates two or more courses of roofing shingles on the single substrate.

7. The roofing shingle of claim 1, wherein the WIS is attached to one or more of a front surface and a side surface of the shingle body.

8. The roofing shingle of claim 1, wherein the shingle body comprises a laminate having a plurality of layers.

9. The roofing shingle of claim 1, wherein the WIS has a thickness that is less than about 50% of a thickness of the shingle body.

10. The roofing shingle of claim 1, wherein the WIS comprises at least one of a trapezoidal shape, a sinusoidal side lap, and a shape with rounded corners.

11. The roofing shingle of claim 1, wherein the WIS is attached to the shingle body with one or more weld, mechanical attachment or a combination thereof.

12. A roofing shingle, comprising:

a shingle body comprising a buttlap portion with a butt edge and a headlap portion with a head edge, a first side edge and a second side edge, an exposure zone extends from the butt edge toward the headlap portion and is configured to be exposed to the environment when the shingle is installed on a roof, and the shingle body comprises an asphaltic or bituminous material; and a water impermeable sheet (WIS) attached to the shingle body, the WIS having a width, length, first end and second end, the width extends from between about the butt and head edges to beyond the head edge of the shingle body to define a headlap, the length extends from between about the first and second side edges to beyond the first side edge to define a sidelap, the second end of the WIS is offset from the second side edge of the shingle body by an amount comparable to an extension of the first end of the WIS beyond the first side edge of the shingle body, and the WIS comprises a polymer; and the width of the WIS extends to the butt edge of the shingle body.

13. A roofing shingle, comprising:

a pair of shingle bodies, each comprising a buttlap portion with a butt edge and a headlap portion with a head edge, a first side edge and a second side edge, an exposure zone extends from the butt edge toward the headlap portion and is configured to be exposed to the environment when the shingle is installed on a roof, and the shingle body comprises an asphaltic or bituminous material;

a water impermeable sheet (WIS) attached to the shingle bodies, the WIS having a width, length, first end and second end, the width extends from between about the butt and head edges to beyond the head edge of the shingle body to define a headlap, the length extends from between about the first and second side edges to beyond the first side edge to define a sidelap, and the WIS comprises a polymer;

the WIS is a single substrate attached to both shingle bodies, and the pair of shingle bodies emulates two or more courses of roofing shingles on the single substrate;

a lower edge of the WIS is offset from the butt edge of the shingle body such that the WIS width is less than a total width of the shingle body; and the second end of the WIS is offset from the second side edge of the shingle body by an amount comparable to an extension of the first end of the WIS beyond the first side edge of the shingle body.

* * * * *

UNITED STATES PATENT AND TRADEMARK OFFICE

CERTIFICATE OF CORRECTION

PATENT NO. : 8,898,963 B1
APPLICATION NO. : 13/667443
DATED : December 2, 2014
INVENTOR(S) : Anna M. Amatruda et al.

It is certified that error appears in the above-identified patent and that said Letters Patent is hereby corrected as shown below:

On Title page 2, item (56) "OTHER PUBLICATIONS", please add --Technical search, 4 pgs, 2012--

Signed and Sealed this
Twenty-ninth Day of September, 2015

Michelle K. Lee

Michelle K. Lee
*Director of the United States Patent and Trademark Office*